US006631767B2

(12) United States Patent
Pringle et al.

(10) Patent No.: US 6,631,767 B2
(45) Date of Patent: Oct. 14, 2003

(54) METHOD AND APPARATUS FOR SELECTIVE INJECTION OR FLOW CONTROL WITH THROUGH-TUBING OPERATION CAPACITY

(75) Inventors: Ronald E. Pringle, Houston, TX (US); Arthur J. Morris, Magnolia, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 45 days.

(21) Appl. No.: 09/441,701

(22) Filed: Nov. 16, 1999

(65) Prior Publication Data

US 2002/0134551 A1 Sep. 26, 2002

Related U.S. Application Data

(60) Provisional application No. 60/108,810, filed on Nov. 17, 1998.

(51) Int. Cl.[7] ..... E21B 34/10; E21B 34/14

(52) U.S. Cl. ..... 166/320; 166/321; 166/332.4; 166/332.8; 166/50

(58) Field of Search ..... 166/321, 313, 166/50, 320, 324, 323, 332.4, 332.8, 327.7

(56) References Cited

U.S. PATENT DOCUMENTS

| | | | | |
|---|---|---|---|---|
| 2,090,180 A | | 8/1937 | Bryant | |
| 2,419,313 A | | 4/1947 | Byrd | |
| 2,681,111 A | | 6/1954 | Thompson | |
| 3,095,041 A | | 6/1963 | Rasmussen | |
| 3,105,553 A | | 10/1963 | Chisolm | |
| 3,395,758 A | | 8/1968 | Kelly et al. | |
| 3,662,826 A | * | 5/1972 | Young et al. | 166/152 |
| 3,664,415 A | * | 5/1972 | Wray et al. | 166/162 |
| 3,741,300 A | | 6/1973 | Wolff et al. | |
| 3,814,181 A | * | 6/1974 | Young | 166/321 |
| 4,043,392 A | * | 8/1977 | Gazda | 166/217 |
| 4,134,454 A | * | 1/1979 | Taylor | 166/320 |
| 4,201,364 A | | 5/1980 | Taylor | |
| 4,253,522 A | | 3/1981 | Setterberg, Jr. | |
| 4,354,554 A | * | 10/1982 | Calhoun et al. | 166/321 |
| 4,440,221 A | * | 4/1984 | Taylor et al. | 166/106 |
| 4,473,122 A | * | 9/1984 | Tamplen | 166/322 |
| 4,858,690 A | | 8/1989 | Rebardi et al. | |
| 4,928,772 A | | 5/1990 | Hopmann | |

(List continued on next page.)

FOREIGN PATENT DOCUMENTS

| | | |
|---|---|---|
| GB | 1 077 562 A | 8/1967 |
| WO | WO 96/10123 | 4/1996 |

*Primary Examiner*—Hoang Dang
(74) *Attorney, Agent, or Firm*—Polasek, Quisenberry & Errington; Jeffrey Griffin; Brigitte Jeffery

(57) ABSTRACT

A downhole flow control device is provided for remotely controlling fluid flow of production or injection fluids, and may offer the capacity to pass wireline tools therethrough. In a broad aspect, the device may include: a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore; and a first sleeve member remotely shiftable within the first bore, and having a second valve seat adapted for cooperable sealing engagement with the first valve seat to regulate fluid flow through the at least one flow port. The device may also include: a closure member disposed for movement between an open and a closed position to control fluid flow through the first bore; a second sleeve member remotely shiftable within the first bore to move the closure member between its open and closed positions; means for selectively controlling movement of the first sleeve member to regulate fluid flow through the at least one flow port; and a cone member for directing fluid flow into the annular space.

31 Claims, 16 Drawing Sheets

U.S. PATENT DOCUMENTS

| | | | |
|---|---|---|---|
| 4,969,524 | A | 11/1990 | Whiteley |
| 5,295,538 | A | 3/1994 | Restarick |
| RE34,758 | E | 10/1994 | Farley et al. |
| 5,377,750 | A | 1/1995 | Arterbury et al. |
| 5,579,844 | A | 12/1996 | Rebardi et al. |
| 5,609,204 | A | 3/1997 | Rebardi et al. |
| 5,730,223 | A | 3/1998 | Restarick |
| 5,755,286 | A | 5/1998 | Ebinger |
| 5,803,179 | A | 9/1998 | Echols et al. |
| 5,865,251 | A | 2/1999 | Rebardi et al. |

* cited by examiner 26
12
3
3
27
10
4
4
22
22
30
28
28
24
5
5
24
21
21
17
17
18
14
26

METHOD AND APPARATUS FOR SELECTIVE INJECTION OR FLOW CONTROL WITH THROUGH-TUBING OPERATION CAPACITY

This application claims priority and the benefit of U.S. Provisional Application No. 60/108,810 filed on Nov. 17, 1998.

BACKGROUND OF THE INVENTION

1. Field of the Invention

The present invention relates to subsurface well equipment and, more particularly, to a method and apparatus for remotely controlling injection or production fluids in well completions which may include gravel pack.

2. Description of the Related Art

As is well known to those of skill in the art, certain hydrocarbon producing formations include sand. Unless filtered out, such sand can become entrained or commingled with the hydrocarbons that are produced to the earth's surface. This is sometimes referred to as "producing sand", and can be undesirable for a number of reasons, including added production costs, and erosion of well tools within the completion, which could lead to the mechanical malfunctioning of such tools. Various approaches to combating this problem have been developed. For example, the industry has developed sand screens which are connected to the production tubing adjacent the producing formation to prevent sand from entering the production tubing. In those cases where sand screens alone will not sufficiently filter out the sand, the industry has learned that a very effective way of filtering sand from entry into the production tubing is to fill, or pack, the well annulus with gravel, hence the term "gravel pack" completions.

A drawback to gravel pack completions arises when it is desired to connect a remotely-controllable flow control device to the production tubing to regulate the flow of production fluids from the gravel-packed well annulus into the production tubing, or to regulate the flow of injection fluids from the production tubing into the gravel-packed well annulus. If the flow control device is of the type that includes a flow port in the sidewall of the body establishing fluid communication between the well annulus and the interior of the tool (such as the flow control device disclosed in U. S. Pat. No. 5,823,623), then the presence of gravel pack in the annulus adjacent the flow port may present an obstacle to the proper functioning of the flow control device, to the extent that the gravel pack may prohibit laminar flow through the flow port. As such, it is an object of the present invention to provide a flow control device that will enable the remote control of flow of production fluids and/or injection fluids in well completions where the annulus is packed with gravel. It is also an object of the present invention to provide such a tool that will enable the passage of wireline tools through the tool so that wireline intervention techniques may be performed at locations in the well below the flow control device.

SUMMARY OF THE INVENTION

The present invention has been contemplated to meet the above described needs. In a broad aspect, the invention may be a downhole flow control device comprising: a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore; and a first sleeve member remotely shiftable within the first bore, and having a second valve seat adapted for cooperable sealing engagement with the first valve seat to regulate fluid flow through the at least one flow port. Another feature of this aspect of the present invention is that the device may further include a closure member disposed for movement between an open and a closed position to control fluid flow through the first bore. Another feature of this aspect of the present invention is that the device may further include means for moving the closure member between its open and closed positions. Another feature of this aspect of the present invention is that the device may further include means for selectively controlling movement of the first sleeve member to regulate fluid flow through the at least one flow port. Another feature of this aspect of the present invention is that the device may further include means for directing fluid flow into the annular space.

In another aspect, the present invention may be a downhole flow control device comprising: a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore; a first sleeve member remotely shiftable within the first bore, and having a second valve seat adapted for cooperable sealing engagement with the first valve seat to regulate fluid flow through the at least one flow port; a closure member disposed for movement between an open and a closed position to control fluid flow through the first bore; and a second sleeve member remotely shiftable within the first bore to move the closure member between its open and closed positions. Another feature of this aspect of the present invention is that the second bore has a diameter greater than a diameter of the first bore. Another feature of this aspect of the present invention is that the first sleeve member further includes at least one flow slot. Another feature of this aspect of the present invention is that the closure member is a flapper hingedly connected to the extension member. Another feature of this aspect of the present invention is that the second sleeve member includes an inner surface having a locking profile for mating with a shifting tool. Another feature of this aspect of the present invention is that the second sleeve member includes at least one rib releasably engageable with at least one annular recess within the first bore of the extension member. Another feature of this aspect of the present invention is that the second sleeve member includes a plurality of collet sections having a plurality of ribs disposed thereon for releasable engagement with at least one annular recess within the first bore of the extension member. Another feature of this aspect of the present invention is that the second sleeve member includes at least one first equalizing port for cooperating with at least one second equalizing port in the extension member to equalize pressure on opposed sides of the closure member prior to shifting the closure member to its open position. Another feature of this aspect of the present invention is that the device may further include seal means for preventing fluid communication between the at least one first and second equalizing ports when the second sleeve member is in a non-equalizing position. Another feature of this aspect of the present invention is that the device may further include a cone member connected to a distal end of the extension member. Another feature of this aspect of the present invention is that the cone member includes a first half-cone member and a second half-cone member, each being hingedly connected to the distal end of the extension member and biased towards each other in a normally-closed position. Another feature of this aspect of the present invention is that an angle formed between a first outer surface of the first half-cone member and a second outer surface of a second half-cone member is approximately forty-four degrees when the cone member is in its normally-closed position. Another feature of this aspect of the present invention is that the second sleeve member is remotely shiftable to a lower position in which the first and second half-cone members are shifted to open positions in which a first inner surface of the first half-cone member is disposed about the second sleeve member, and a second inner surface of the second half-cone member is disposed about the second sleeve member. Another feature of this aspect of the present invention is that the device may further include a piston connected to the first sleeve member and movably disposed within the body member in response to application of pressure. Another feature of this aspect of the present invention is that the device may further include a first hydraulic conduit connected between a source of pressurized fluid and the body member, and being in fluid communication with a first side of the piston. Another feature of this aspect of the present invention is that the device may further include a spring disposed within the body member and biasing the first sleeve member and the second valve seat toward the first valve seat. Another feature of this aspect of the present invention is that the device may further include a contained source of pressurized gas in fluid communication with a second side of the piston. Another feature of this aspect of the present invention is that the pressurized gas is contained within a gas conduit connected to the body member. Another feature of this aspect of the present invention is that the device may further include a second hydraulic conduit connected between the source of pressurized fluid and the body member, and being in fluid communication with a second side of the piston. Another feature of this aspect of the present invention is that the device may further include a port in the body member establishing fluid communication between a well annulus and a second side of the piston. Another feature of this aspect of the present invention is that the device may further include a position holder cooperably engageable with a retaining member, one of the position holder and the retaining member being connected to the first sleeve member, and the other of the position holder and the retaining member being connected to the body member. Another feature of this aspect of the present invention is that the position holder includes a recessed profile in which a portion of the retaining member is engaged and movably disposed to hold the sleeve member in a plurality of discrete positions. Another feature of this aspect of the present invention is that the recessed profile includes a plurality of axial slots of varying lengths disposed circumferentially about the position holder and in substantially parallel relationship, and corresponding to a plurality of discrete positions for the first sleeve member, each axial slot having a recessed portion and an elevated portion, and each axial slot being connected to its immediately neighboring axial slots by ramped slots leading between corresponding recessed and elevated portions of each neighboring axial slot. Another feature of this aspect of the present invention is that the recessed profile is disposed in an indexing cylinder rotatably disposed about the first sleeve member. Another feature of this aspect of the present invention is that the indexing cylinder and the sleeve member are adapted to restrict longitudinal movement therebetween. Another feature of this aspect of the present invention is that the retaining member includes an elongate body having a cam finger at a distal end thereof engaged with and movably disposed within a recessed profiled in the position holder, and a proximal end of the elongate body being hingedly attached to one of the sleeve member and body member. Another feature of this aspect of the present invention is that the device may further include means for biasing the retaining member into engagement with the position holder.

In another aspect, the invention may be a downhole flow control device comprising: a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore; a first sleeve member remotely shiftable within the first bore, and having a second valve seat adapted for cooperable sealing engagement with the first valve seat to regulate fluid flow through the at least one flow port; a closure member disposed for movement between an open and a closed position to control fluid flow through the first bore; a second sleeve member remotely shiftable within the first bore to move the closure member between its open and closed positions; and a cone member connected to a distal end of the extension member. Another feature of this aspect of the present invention is that the cone member includes a first half-cone member and a second half-cone member, each being hingedly connected to the distal end of the extension member and biased towards each other in a normally-closed position. Another feature of this aspect of the present invention is that an angle formed between a first outer surface of the first half-cone member and a second outer surface of a second half-cone member is approximately forty-four degrees when the cone member is in its normally-closed position. Another feature of this aspect of the present invention is that the first sleeve member further includes at least one flow slot. Another feature of this aspect of the present invention is that the closure member is a flapper hingedly connected to the extension member. Another feature of this aspect of the present invention is that the device may further include a piston connected to the first sleeve member and movably disposed within the body member in response to application of pressure. Another feature of this aspect of the present invention is that the device may further include means for moving the piston. Another feature of this aspect of the present invention is that the device may further include means for holding the first sleeve member in a plurality of discrete positions.

In another aspect, the present invention may be a downhole flow control device comprising: a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore; a first sleeve member remotely shiftable within the first bore, and having a second valve seat adapted for cooperable sealing engagement with the first valve seat;

to regulate fluid flow through the at least one flow port; a piston connected to the first sleeve member and movably disposed within the body member; a closure member disposed for movement between an open and a closed position to control fluid flow through the first bore; and a second sleeve member remotely shiftable within the first bore to move the closure member between its open and closed positions. Another feature of this aspect of the present invention is that the device may further include means for moving the piston within the body member. Another feature of this aspect of the present invention is that the device may further include means for holding the first sleeve member in a plurality of discrete positions. Another feature of this aspect of the present invention is that the first sleeve member further includes at least one flow slot. Another feature of this aspect of the present invention is that the closure member is a flapper hingedly connected to the extension member. Another feature of this aspect of the present invention is that the device may further include a cone member connected to a distal end of the extension member.

In another aspect, the present invention may be a method of producing hydrocarbons from a hydrocarbon formation through a well completion, the well completion including a production tubing disposed within a well casing, a packer connected to the tubing and disposed above the formation, gravel disposed in an annulus between the production tubing and the well casing, a sand screen connected to the tubing and disposed adjacent the formation, and a flow control device connected to the tubing between the sand screen and the packer, the method comprising the steps of: allowing production fluids to flow from the formation through the gravel pack, through the sand screen, into the production tubing, and into the flow control device; regulating fluid flow through the flow control device; and producing the production fluids through the production tubing to a remote location.

In another aspect, the present invention may be a method of injecting fluids through a well completion into a hydrocarbon formation, the well completion including a production tubing disposed within a well casing, a packer connected to the tubing and disposed above the formation, gravel disposed in an annulus between the production tubing and the well casing, a sand screen connected to the tubing and disposed adjacent the formation, and a flow control device connected to the tubing between the sand screen and the packer, the method comprising the steps of: allowing injection fluids to flow from a remote location into the flow control device; regulating flow of the injection fluids through the flow control device; and injecting the injection fluids into the formation.

In another aspect, the present invention may be a method of producing hydrocarbons from a hydrocarbon formation through a well completion, the well completion including a production tubing disposed within a well casing, a packer connected to the tubing and disposed above the formation, gravel disposed in an annulus between the production tubing and the well casing, and a flow control device having a body member and a first sleeve member, the body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore, and the first sleeve member being remotely shiftable within the first bore, and having a second valve seat adapted for cooperable sealing engagement with the first valve seat to regulate fluid flow through the at least one flow port, the method comprising the steps of: allowing production fluids to flow from the formation through the gravel pack, into the production tubing, and into the annular space; shifting the first sleeve member to separate the first and second valve seats to permit fluid communication between the first bore and the annular space; producing the production fluids through the production tubing to a remote location. Another feature of this aspect of the present invention is that the method may further include the step of shifting the first sleeve member to regulate fluid flow through the at least one flow port.

In another aspect, the present invention may be a well completion including: a well casing in fluid communication with a first hydrocarbon formation; a production tubing disposed within the well casing; gravel packed in an annulus between the well casing and the production tubing; a first packer connected to the tubing and disposed above the first hydrocarbon formation; a first sand screen adjacent the first hydrocarbon formation, connected to the tubing, and establishing fluid communication between the first hydrocarbon formation and the production tubing; a first flow control device connected to the tubing and disposed between the first packer and the first hydrocarbon formation, the first flow control device having a body member and a first sleeve member, the body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore, and the first sleeve member being remotely shiftable within the first bore, and having a second valve seat adapted for cooperable sealing engagement with the first valve seat to regulate fluid flow through the at least one flow port. Another feature of this aspect of the present invention is that the first end of the body member is positioned above the second end of the body member. Another feature of this aspect of the present invention is that the second end of the body member is positioned above the first end of the body member. Another feature of this aspect of the present invention is that the well completion may further include a first hydraulic conduit connected between a source of pressurized fluid and the first flow control device. Another feature of this aspect of the present invention is that the completion may further include: a second packer connected to the tubing and disposed below the first hydrocarbon formation and above a second hydrocarbon formation; a second sand screen adjacent the second hydrocarbon formation, connected to the tubing, and establishing fluid communication between the second hydrocarbon formation and the production tubing; and a second flow control device connected to the tubing and disposed between the second packer and the first hydrocarbon formation, the second flow control device having a body member and a first sleeve member, the body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore, and the first sleeve member being remotely shiftable within the first bore, and having a second valve seat adapted for cooperable sealing engagement with the first valve seat to regulate fluid flow through the at least one flow port. Another feature of this aspect of the present invention is that the completion may further include a second hydraulic conduit connected between the source of pressurized fluid and the second flow control device.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

For the purposes of this description, the terms "upper" and "lower," "up hole" and "downhole" and "upwardly" and "downwardly" are relative terms to indicate position and direction of movement in easily recognized terms. Usually, these terms are relative to a line drawn from an upmost position at the earth's surface to a point at the center of the earth, and would be appropriate for use in relatively straight, vertical wellbores. However, when the wellbore is highly deviated, such as from about 60 degrees from vertical, or horizontal, these terms do not make sense and therefore should not be taken as limitations. These terms are only used for ease of understanding as an indication of what the position or movement would be if taken within a vertical wellbore.

Figure 1A:
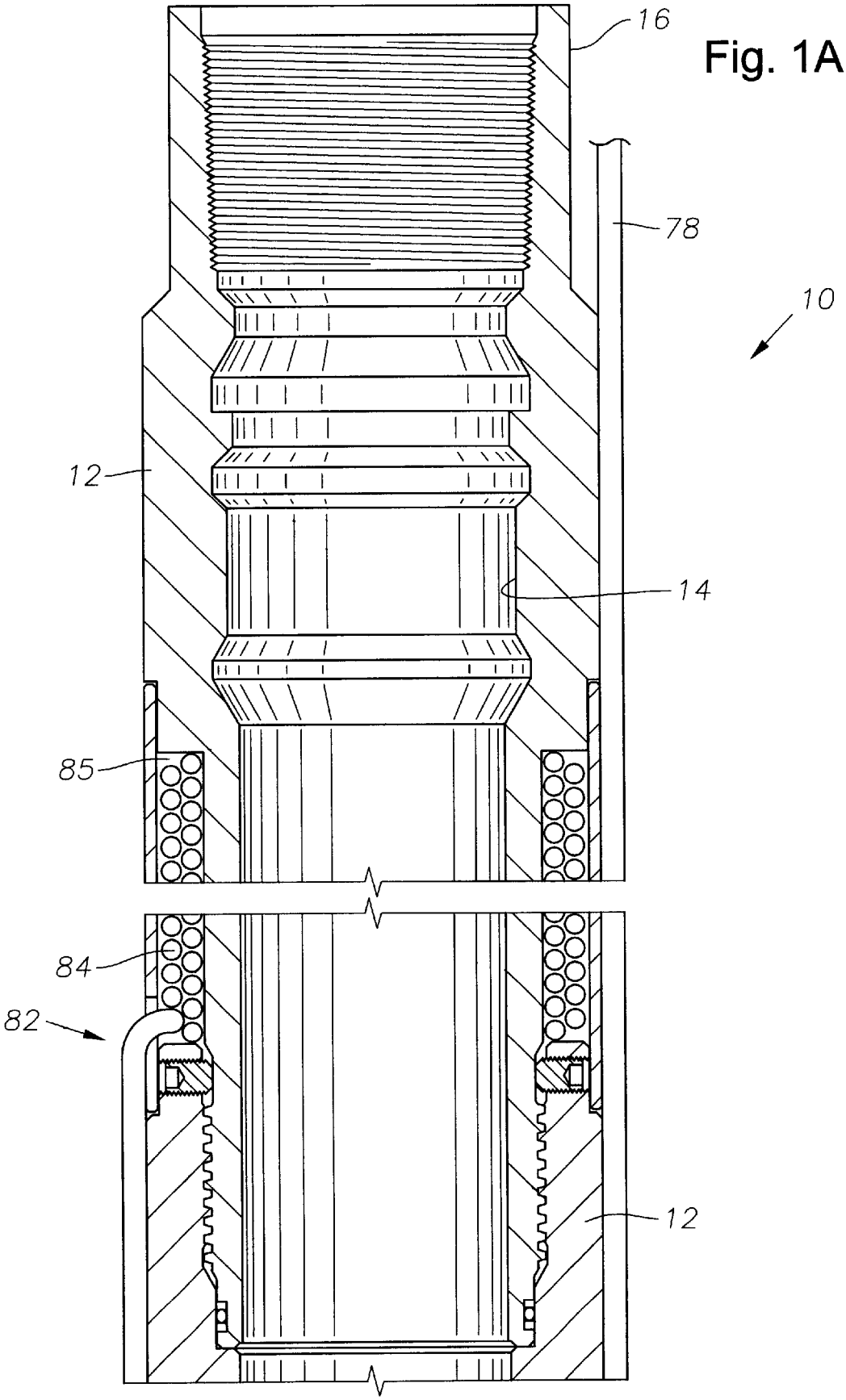
FIGS. 1A–1J taken together form a longitudinal sectional view of a specific embodiment of the flow control device of the present invention.
Figure 1B:
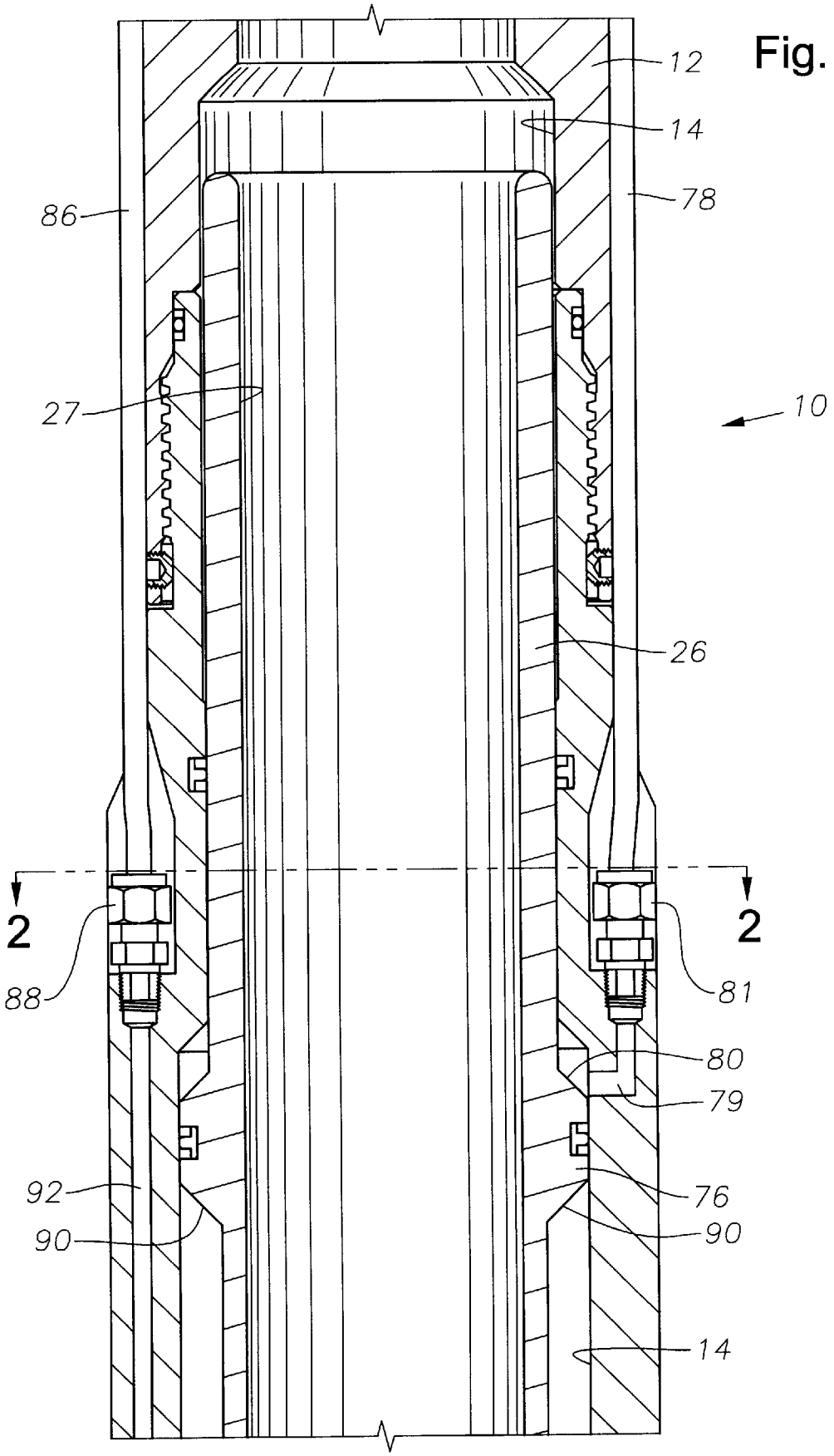
Figure 1C:
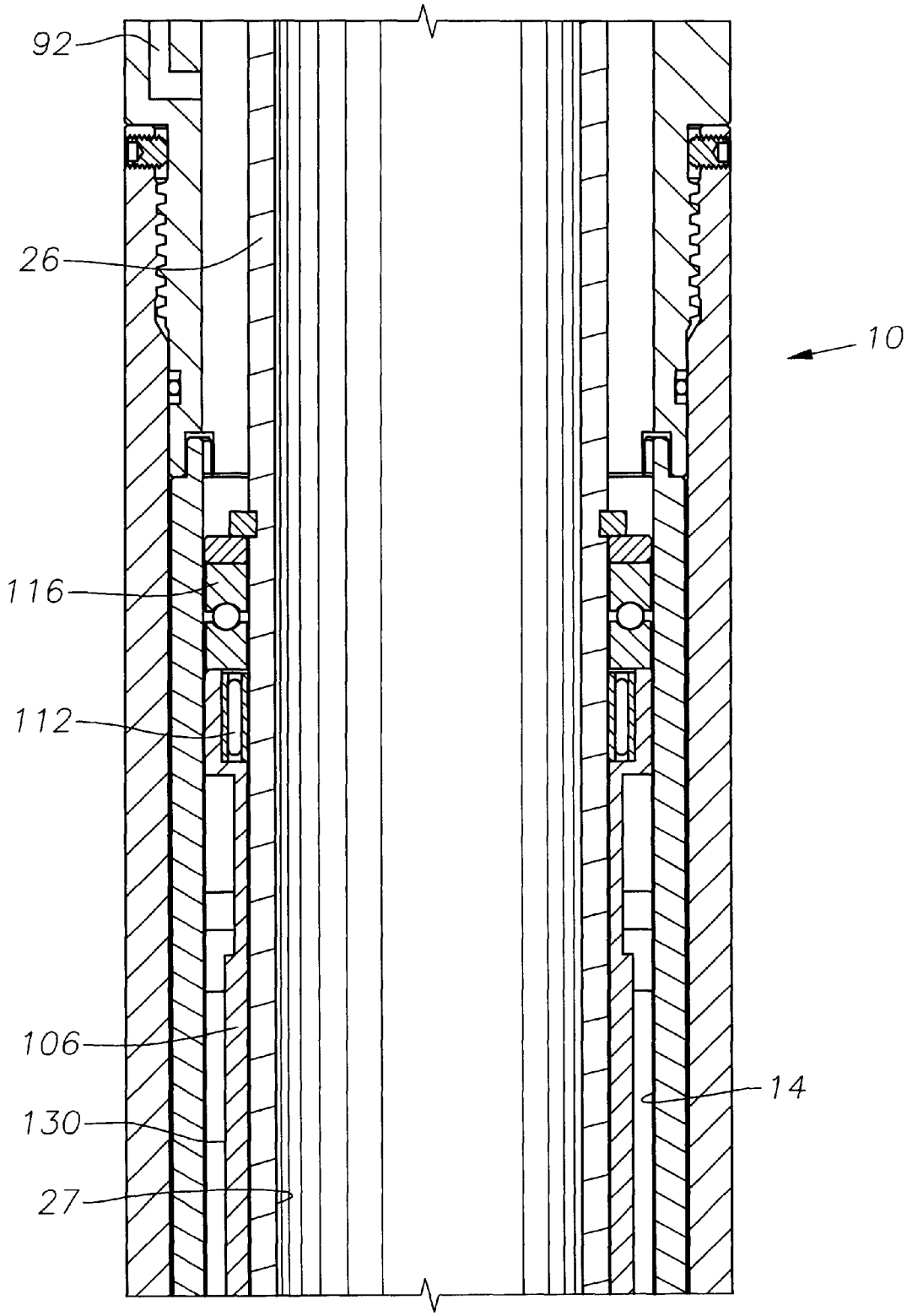
Figure 1D:
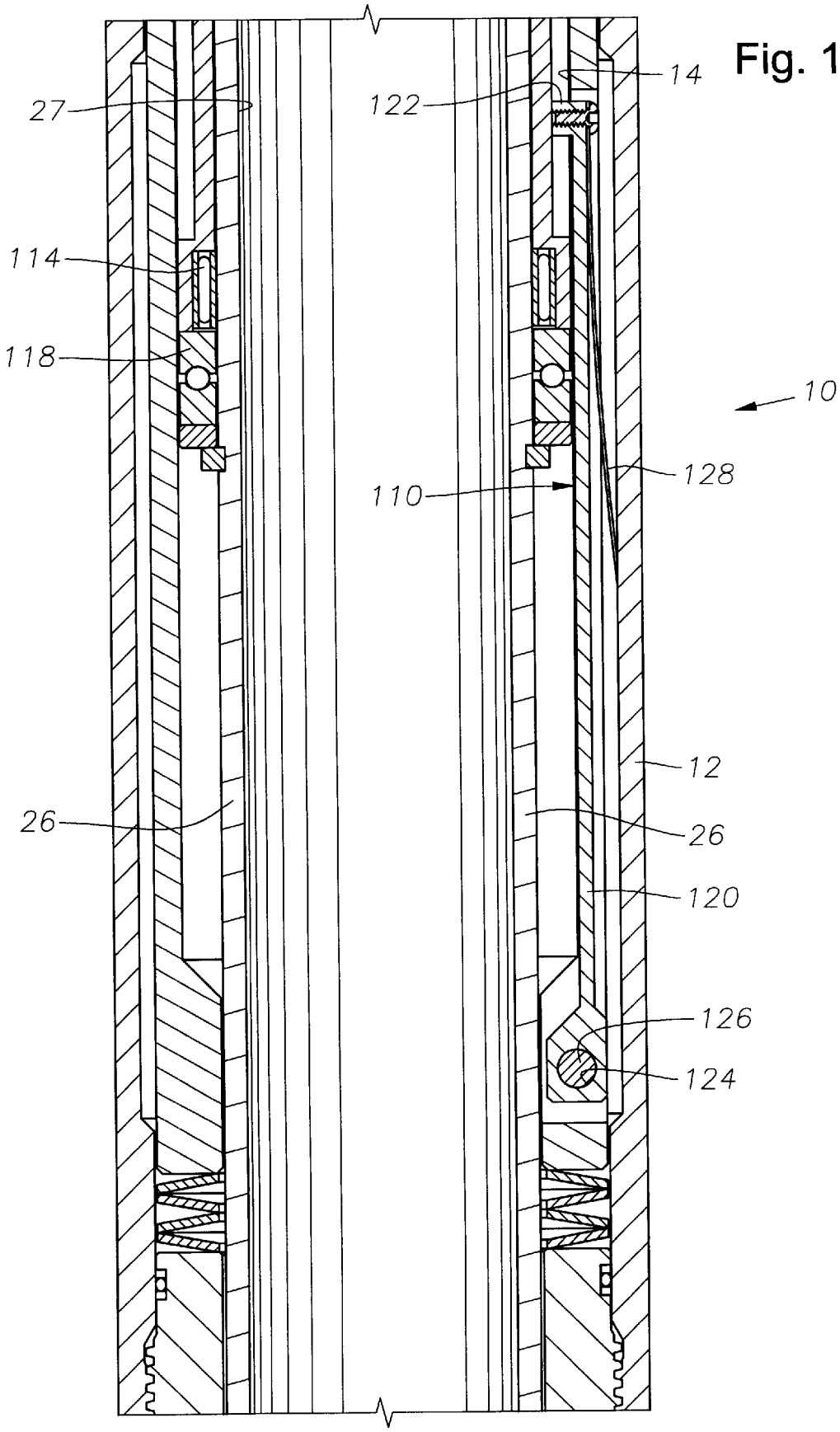
Figure 1E:
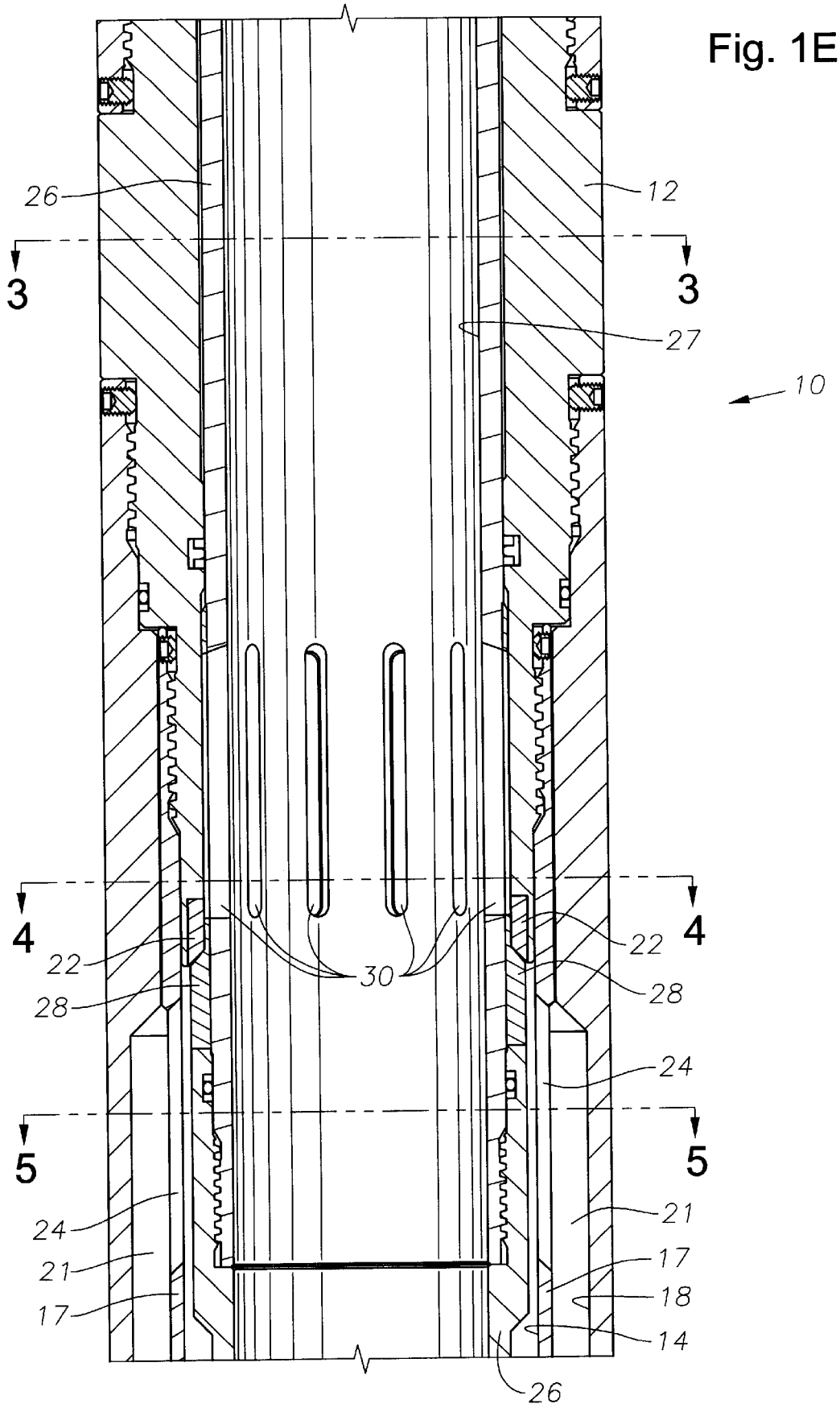

Referring to the drawings in detail, wherein like numerals denote identical elements throughout the several views, a specific embodiment of the downhole flow control device of the present invention is referred to generally by the numeral 10. Referring initially to FIG. 1A, the device 10 may include a generally cylindrical body member 12 having a first bore 14 extending from a first end 16 of the body member 12 and through a generally cylindrical extension member 17 (FIGS. 1E–1I) disposed within the body member 12, and a second bore 18 extending from a second end 20 of the body member 12 and into an annular space 21 disposed about the extension member 17. In a specific embodiment, the diameter of the second bore 18 is greater than the diameter of the first bore 14. As shown in FIG. 1E, the body member 12 may also include a first valve seat 22 disposed within the first bore 14, and the extension member 17 may include at least one flow port 24 establishing fluid communication between the annular space 21 and the first bore 14.

With reference to FIGS. 1B–1F, the device 10 may further include a first generally cylindrical sleeve member 26 movably disposed and remotely shiftable within the first bore 14. The manner in which the first sleeve member 26 is shifted within the first bore 14 will be described below. Referring to FIG. 1E, the first sleeve member 26 may include a second valve seat 28 adapted for cooperable sealing engagement with the first valve seat 22 to regulate fluid flow through the at least one flow port 24. The first sleeve member 26 may also include at least one flow slot 30.

Figure 1F:
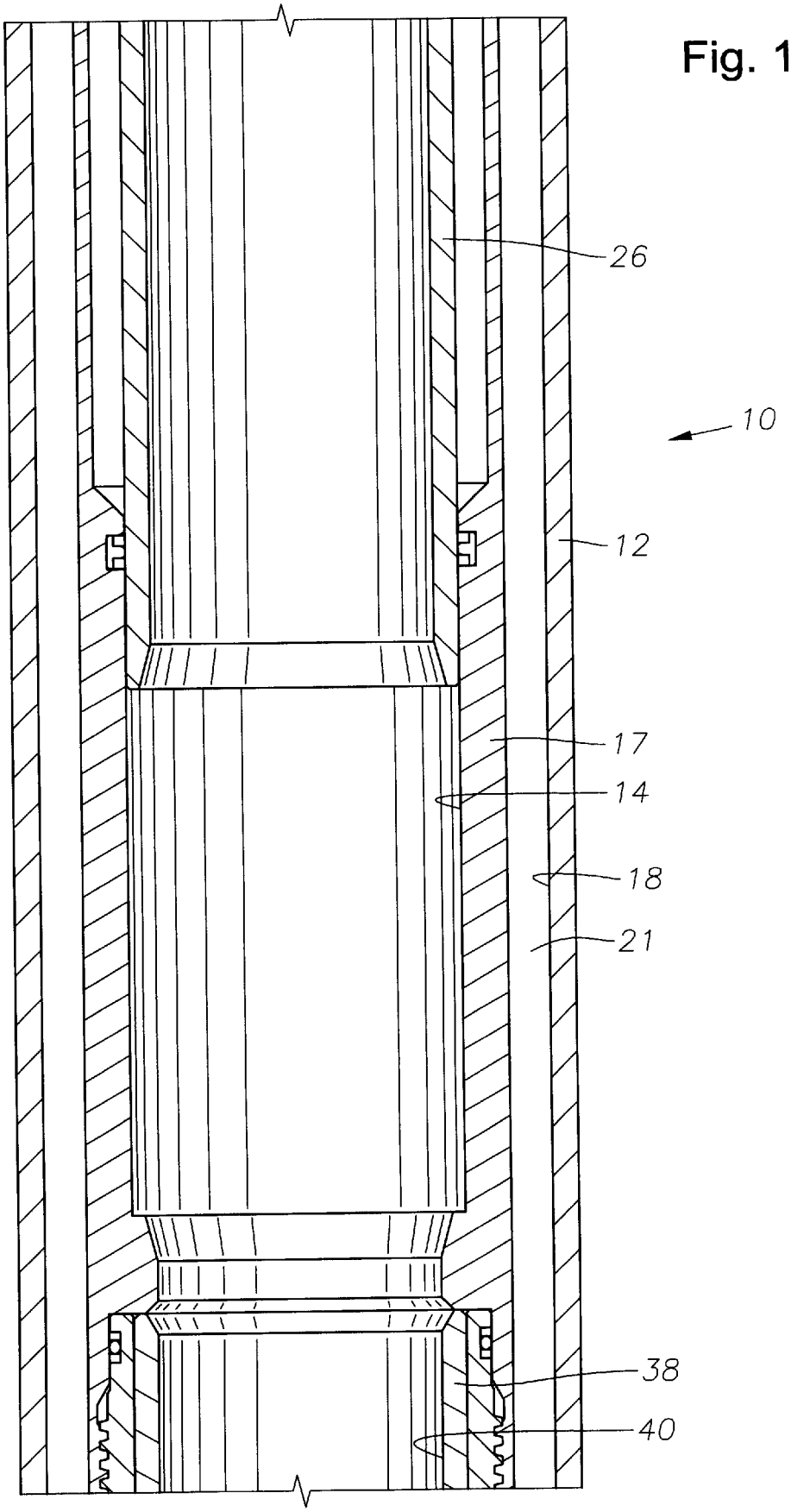
Figure 1G:
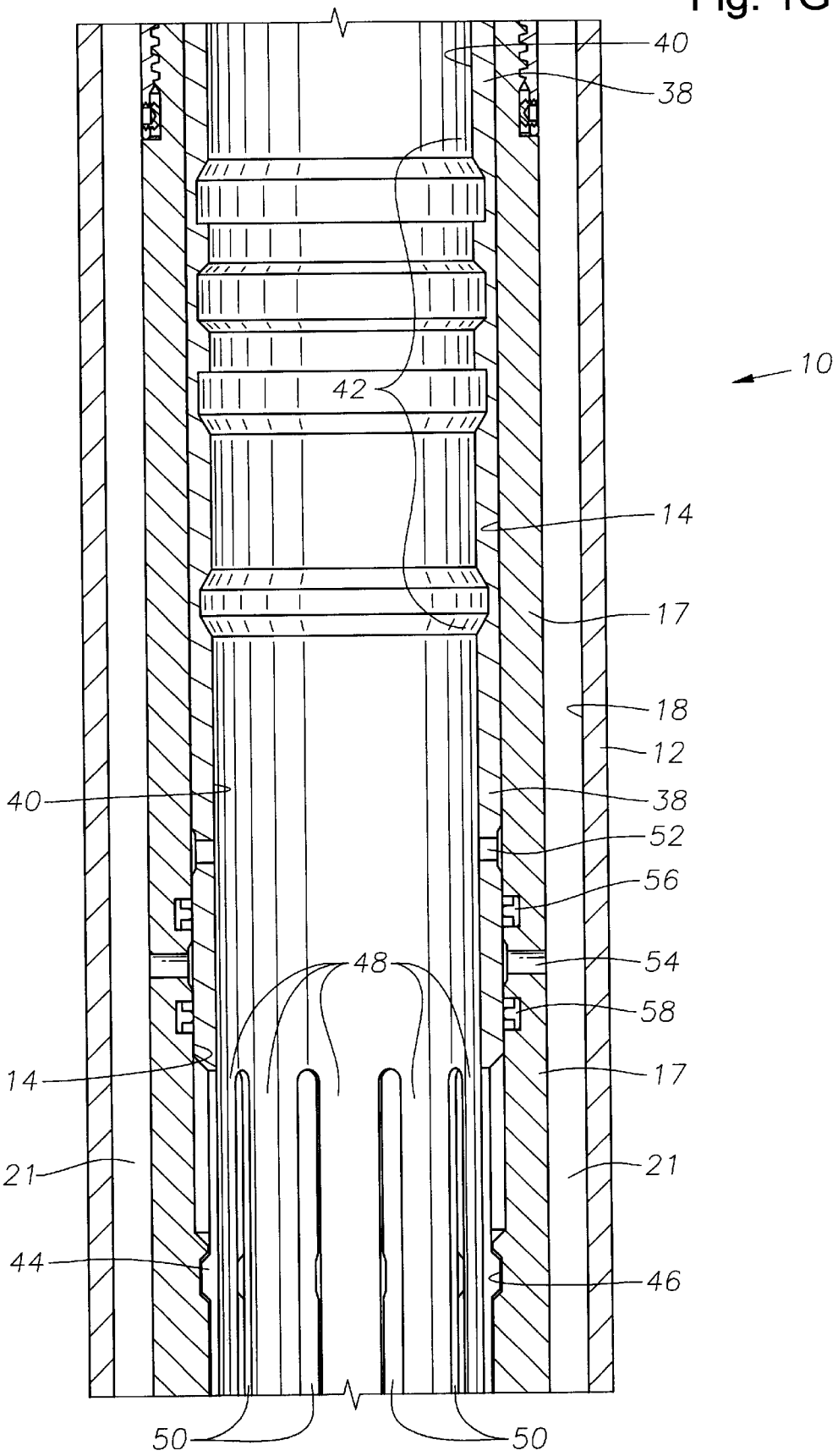
Figure 1H:
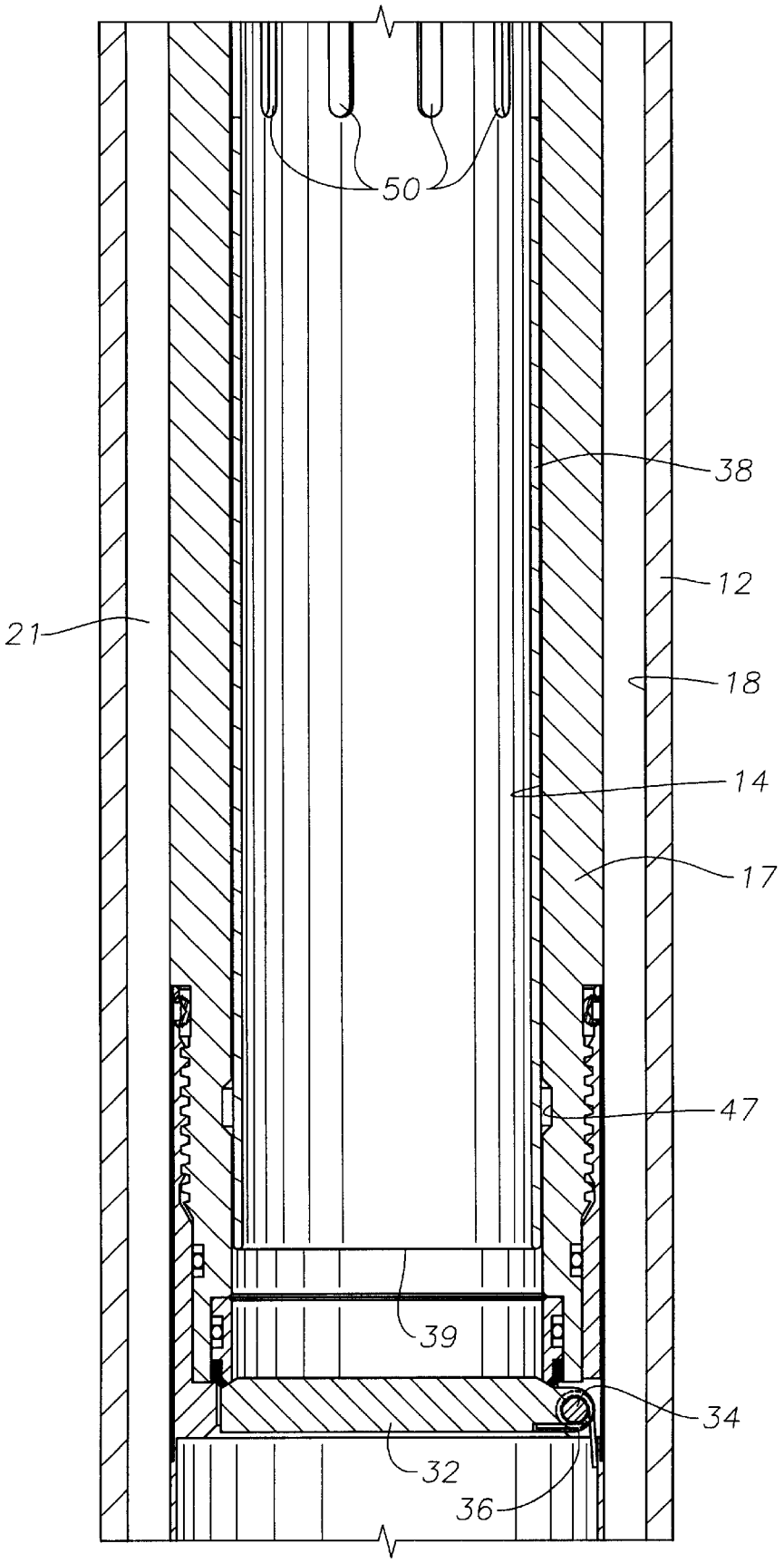
Figure 1L:
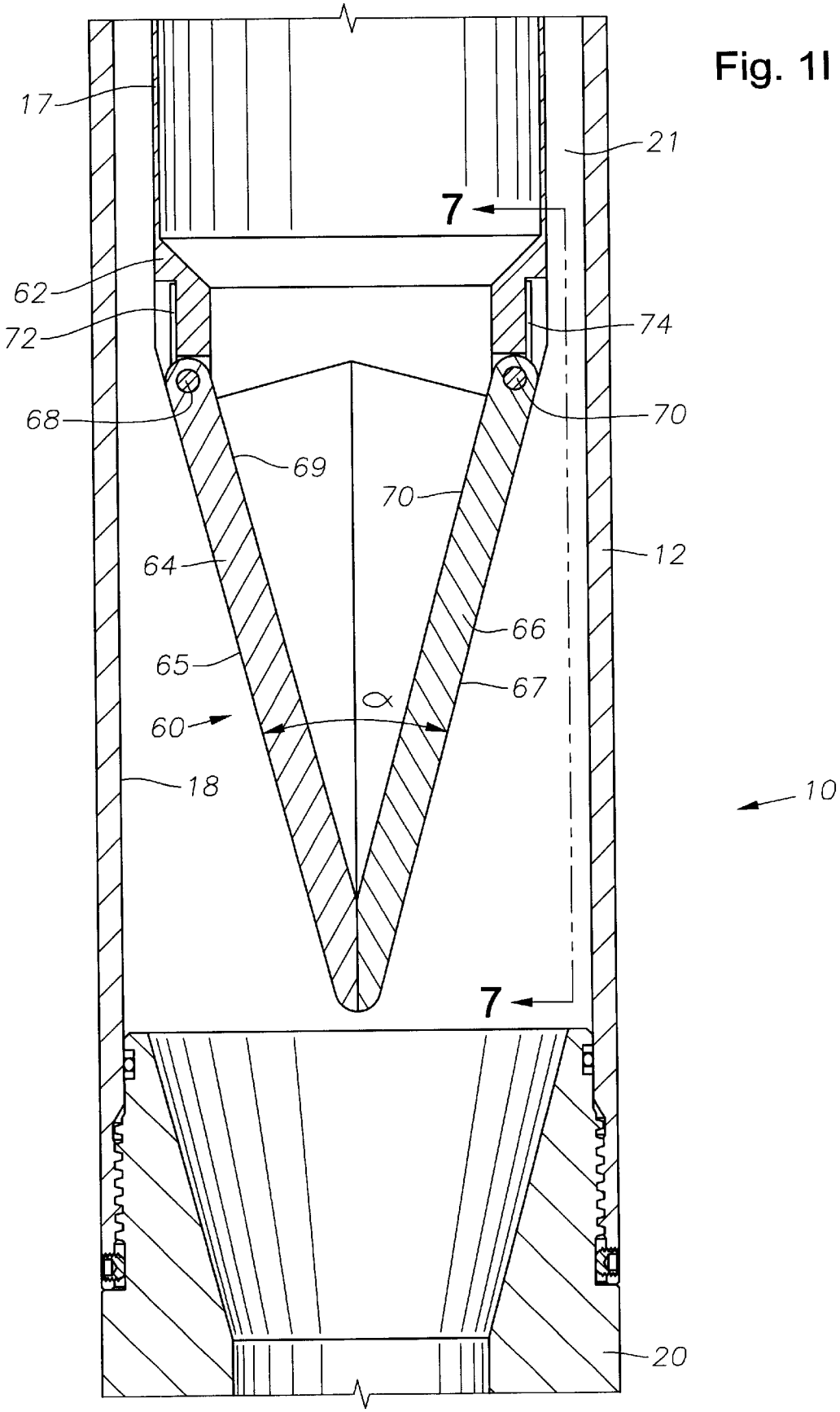
Figure 1J:
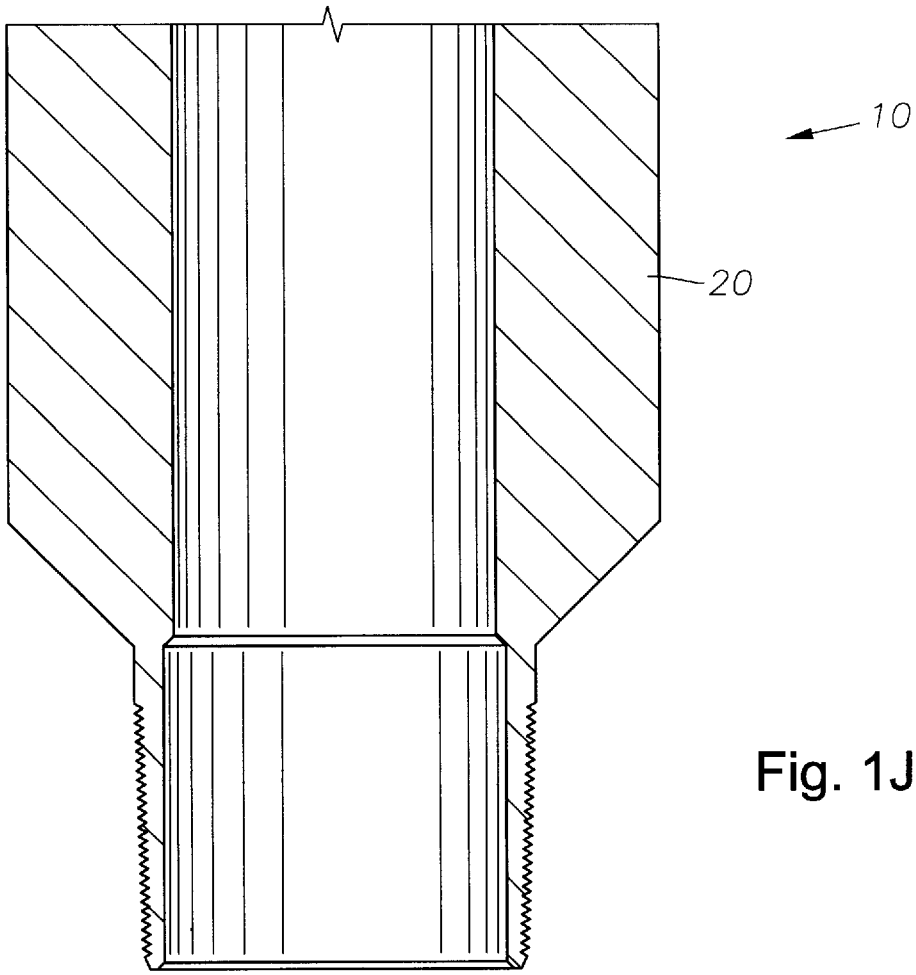
Figure 2:
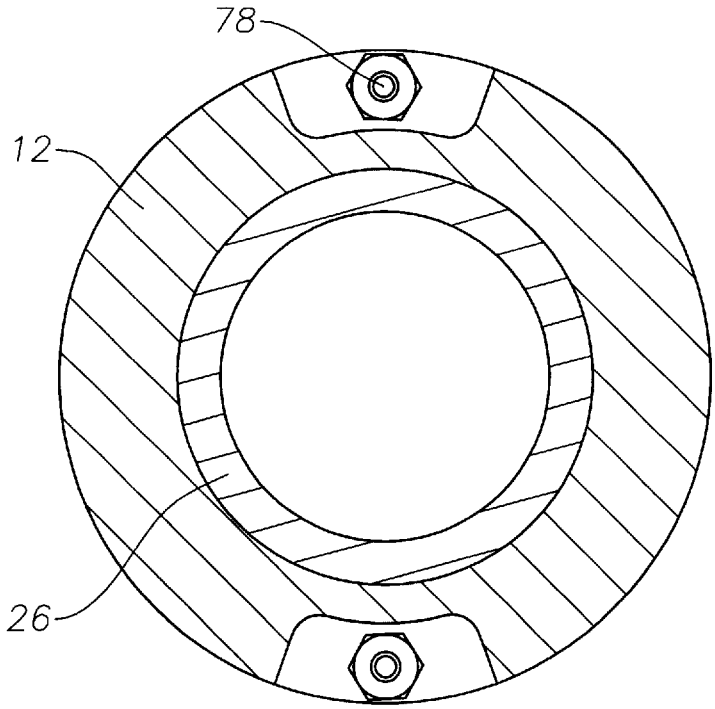
FIG. 2 is a cross-sectional view taken along line 2—2 of FIG. 1B.

As shown in FIG. 1H, the device 10 may further include a closure member 32 disposed for movement between an open and a closed position to control fluid flow through the first bore 14. The closure member 32 is shown in its closed position. In a specific embodiment, the closure member 32 may be a flapper having an arm 34 hingedly connected to the extension member 17. The flapper 32 may be biased into its closed position by a hinge spring 36. Other types of closure members 32 are within the scope of the present invention, including, for example, a ball valve.

As shown in FIGS. 1F–1H, the device 10 may further include a second sleeve member 38 movably disposed and remotely shiftable within the first bore 14 to move the closure member 32 between its open and closed positions. As shown in FIG. 1E, the second sleeve member 38 may include an inner surface 40 having a locking profile 42 disposed therein for mating with a shifting tool (not shown). As shown in FIG. 1G, the second sleeve member 38 may also include at least one rib 44 that is shown engaged with a first annular recess 46 in the first bore 14 of the extension member 17. In a specific embodiment, the second sleeve member 38 may include a plurality of ribs 44 disposed on a plurality of collet sections 48 in the second sleeve member 38 that may be disposed between a plurality of slots 50 in the second sleeve member 38. As will be more fully discussed below, the second sleeve member 38 may be shifted downwardly to engage the ribs 44 with a second annular recess 47 in the first bore 14 of the extension member 17. The second sleeve member 38 may further include at least one first equalizing port 52 for cooperating with at least one second equalizing port 54 in the extension member 17 to equalize pressure above and below the flapper 32 prior to shifting the second sleeve member 38 downwardly to open the flapper 32. The first equalizing port 52 establishes fluid communication between the inner surface 40 of the second sleeve member 38 and the first bore 14 of the extension member 17. The second equalizing port 54 establishes fluid communication between the first bore 14 of the extension member 17 and the annular space 21. A first annular seal 56 and a second annular seal 58 may be disposed within the first bore 14 of the extension member 17 and in sealing relationship about the second sleeve member 38. The second equalizing port 54 is disposed between the first and second annular seals 56 and 58. When the ribs 44 on the second sleeve member 38 are engaged with the first annular recess 46 in the extension member 17, the first annular seal 56 is disposed between the first and second equalizing ports 52 and 54, and a distal end 39 of the second sleeve member 38 is spaced from the closure member 32.

When it is desired to open the flapper 32, to enable passage of wireline tools (not shown) to positions below the device 10, a wireline shifting tool (not shown) may be engaged with the locking profile 42 (FIG. 1G) and used to shift the second sleeve member 38 downwardly until the distal end 39 (FIG. 1H) of the second sleeve member 38 comes into contact with the flapper 32. This will align the first and second equalizing ports 52 and 54, and thereby establish fluid communication between the annular space 21 and the inner surface 40 of the second sleeve member 38. In this manner, pressure may be equalized above and below the flapper 32 prior to opening of the flapper 32. The second sleeve member 38 may then continue downwardly to push the flapper 32 open, without having to overcome upward forces imparted to the flapper 32 by pressure below the flapper 32. It is noted, with reference to FIG. 1E, that pressure above and below the flapper 32 may also be equalized prior to opening of the flapper 32 by shifting the first sleeve member 26 to separate the first and second valve seats 22 and 28 to establish fluid communication between the annular space 21 and an inner surface 27 of the first sleeve member 26.

Figure 7:
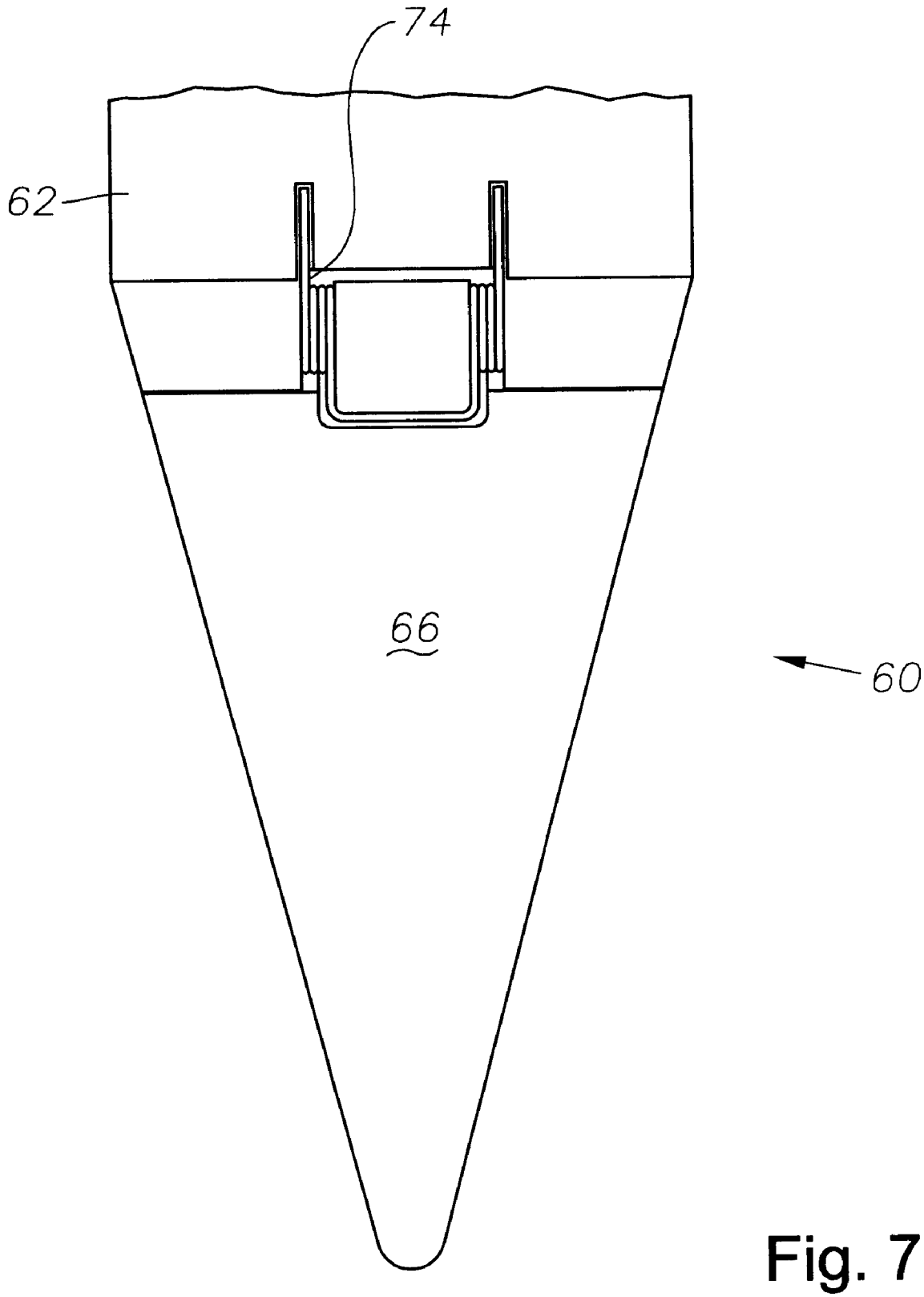
FIG. 7 is a partial elevation view taken along line 7—7 of FIG. 11.

With reference to FIGS. 1I and 7, the device 10 may further include a cone member 60 connected to a distal end 62 of the extension member 17. In a specific embodiment, the cone member 60 may include a first and a second half-cone member 64 and 66, each of which may be hingedly attached to the distal end 62 of the extension member 17, as by a first and a second hinge pin 68 and 70, respectively, and biased towards each other, as by first and second hinge springs 72 and 74, respectively. The springs 72 and 74 bias and hold the half-cone members 64 and 66 in mating relationship, or in a normally-closed position, to form a cone, as shown in FIG. 1I. In this normally-closed position, the cone member 60 directs fluid flowing from the second end 20 of the body member 12 into the annular space 21, and functions to minimize turbulence as fluid flows into the annular space 21. In this regard, in a preferred embodiment, an angle a formed between a first outer surface 65 of the first half-cone member 64 and a second outer surface 67 of the second half-cone member 66 may be approximately forty-four (44) degrees when the half-cone members 64 and 66 are biased towards each other to form a cone, as shown in FIG. 1I. When it is desired to pass a wireline tool through the device 10 from the first end 16 of the body member 12 to the second end 20 of the body member, then the second sleeve member 38 (FIGS. 1F–1H) may be shifted downwardly (by locating a wireline shifting tool (not shown) in the locking profile 42, as discussed above) from its position shown in FIGS. 1F–1H to a lower position (not shown) in which the first and second half-cone members 64 and 66 are separated and their respective inner surfaces 69 and 70 are disposed about the second sleeve member 38. With reference to FIG. 1G, the ribs 44 on the second sleeve member 38 may be disposed within the second annular recess 47 in the extension member 17 when the second sleeve member 38 is in its lower position (not shown).

The manner in which the first sleeve member 26 is remotely shifted will now be described. Referring to FIGS. 1B–1D, in a specific embodiment, a piston 76 may be connected to, or a part of, the first sleeve member 26, and may be sealably, slidably disposed within the first bore 14 of the body member 12. In a specific embodiment, the piston 76 may be an annular piston or at least one rod piston. A first hydraulic conduit 78 is connected between a source of hydraulic fluid (not shown), such as at the earth's surface (not shown), and the body member 12, as at fitting 81, and is in fluid communication with a first side 80 of the piston 76, such as through a first passageway 79 in the body member 12. The first sleeve member 26 may be remotely shifted downwardly, or away from the first end 16 of the body member 12, by application of pressurized fluid to the first side 80 of the piston 76. A number of mechanisms for biasing the first sleeve member 26 upwardly, or towards the first end 16 of the body member 12, may be provided within the scope of the present invention, including but not limited to another hydraulic conduit, pressurized gas, spring force, and annulus pressure, and/or any combination thereof.

Figure 3:
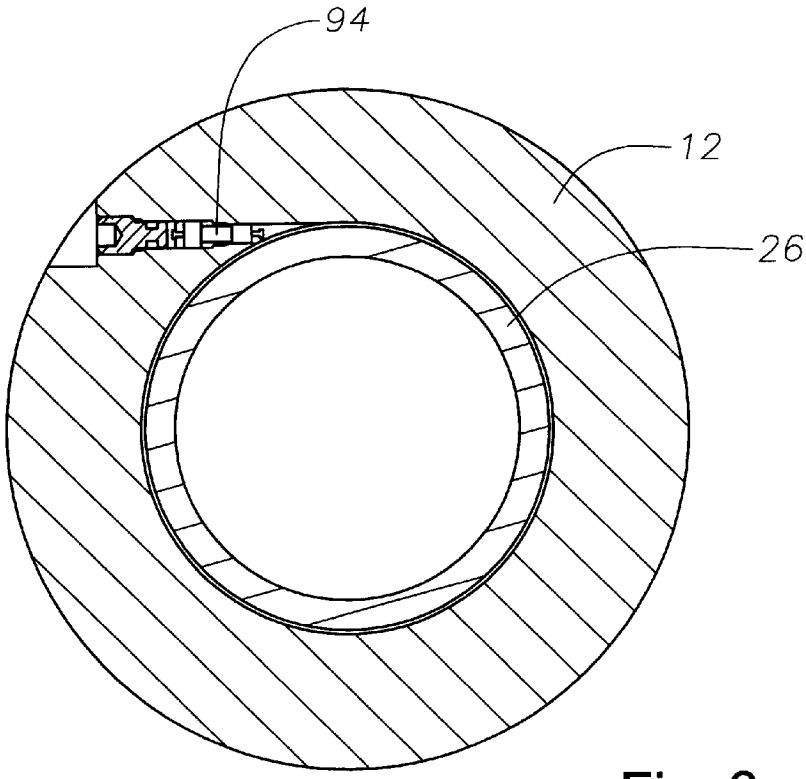
FIG. 3 is a cross-sectional view taken along line 3—3 of FIG. 1E.
Figure 4:
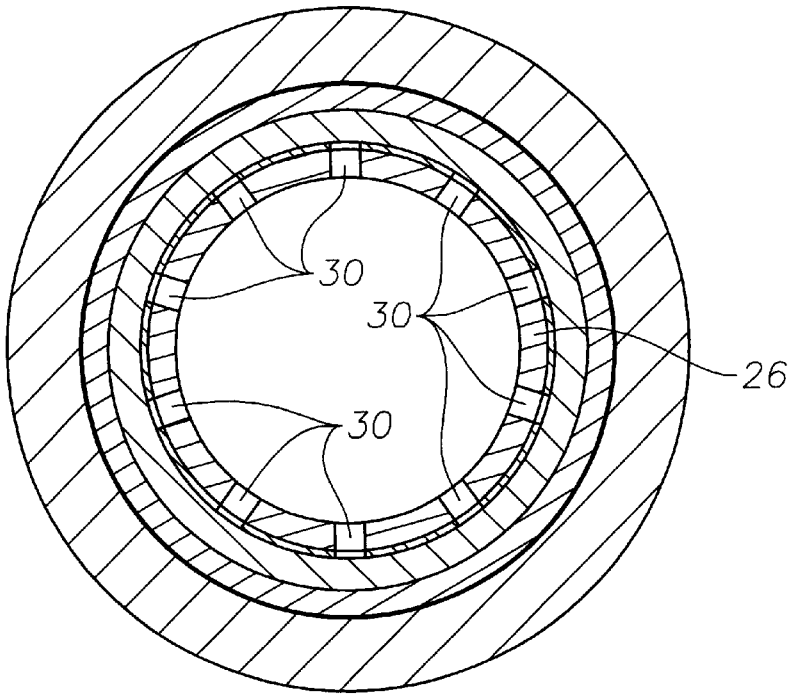
FIG. 4 is a cross-sectional view taken along line 4—4 of FIG. 1E.
Figure 5:
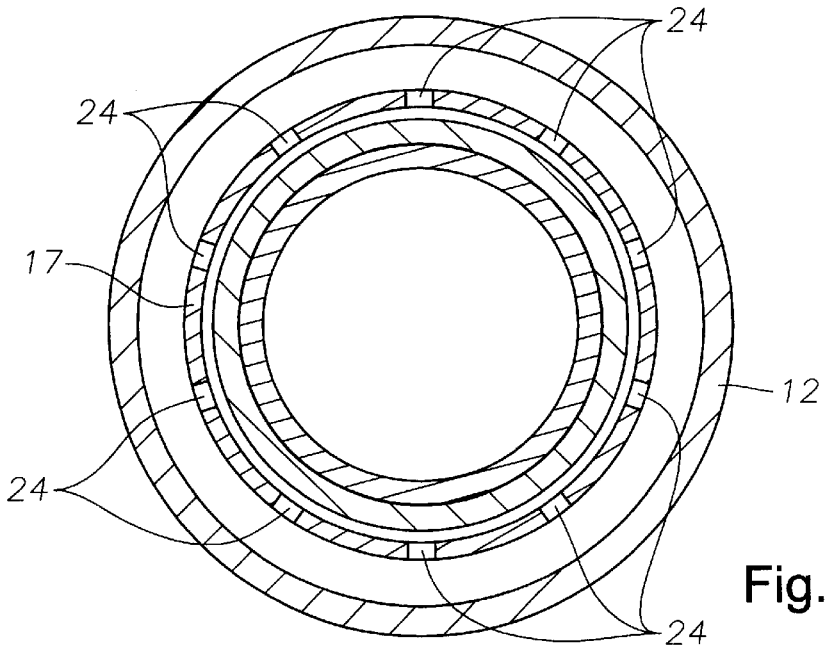
FIG. 5 is a cross-sectional view taken along line 5—5 of FIG. 1E.

In a specific embodiment, as shown in FIG. 1A, the biasing mechanism may include a source of pressurized gas, such as pressurized nitrogen, which may be contained within a sealed chamber, such as a gas conduit 82. An upper portion 84 of the gas conduit 82 may be coiled within a housing 85 formed within the body member 12, and a lower portion 86 of the gas conduit 82 (FIG. 1B) may extend outside the body member 12 and terminate at a fitting 88 connected to the body member 12. The gas conduit 82 is in fluid communication with a second side 90 of the piston 76, such as through a second passageway 92 in the body member 12. Appropriate seals are provided to contain the pressurized gas. As shown in FIG. 3, the body member 12 may include a charging port 94, which may include a dill core valve, through which pressurized gas may be introduced into the device 10.

Figure 8:
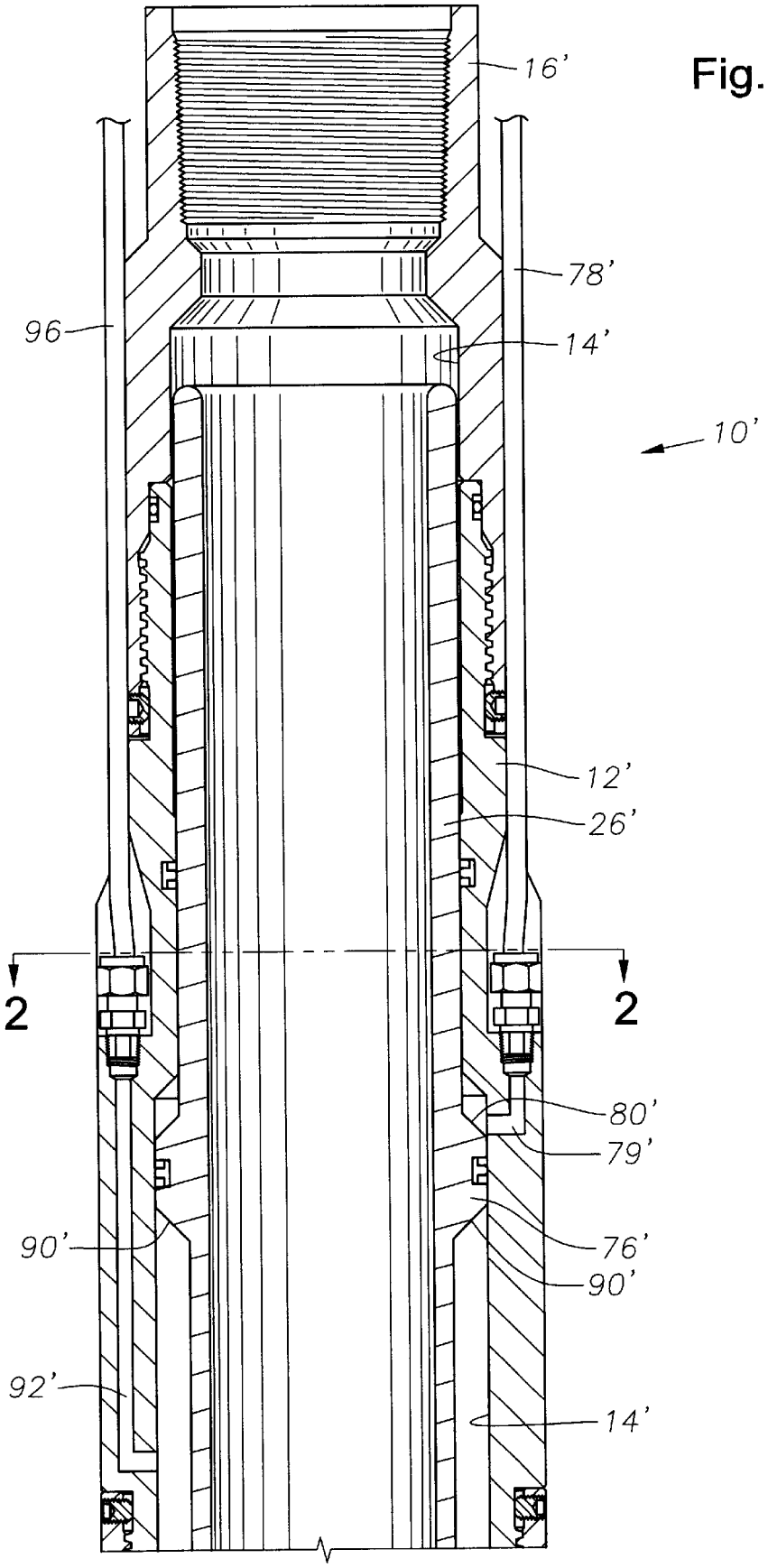
FIG. 8 is a longitudinal sectional view, similar to FIGS. 1A and 1B, showing an upper portion of another specific embodiment of the flow control device of the present invention.

Another biasing mechanism is shown in FIG. 8, which is a view similar to FIGS. 1A and 1B, and illustrates an upper portion of another specific embodiment of the present invention, which is referred to generally by the numeral 10'. The lower portion of this embodiment is the same as shown in FIGS. 1C–1I. In this embodiment, a second hydraulic conduit 96 is connected between a source of hydraulic fluid (not shown), such as at the earth's surface (not shown), and the body member 12', and is in fluid communication with the second side 90' of the piston 76', such as through the second passageway 92' in the body member 12'. As such, in this embodiment, hydraulic fluid is used instead of pressurized gas to bias the first sleeve member 26' towards the first end 16' of the body member 12'.

Figure 9:
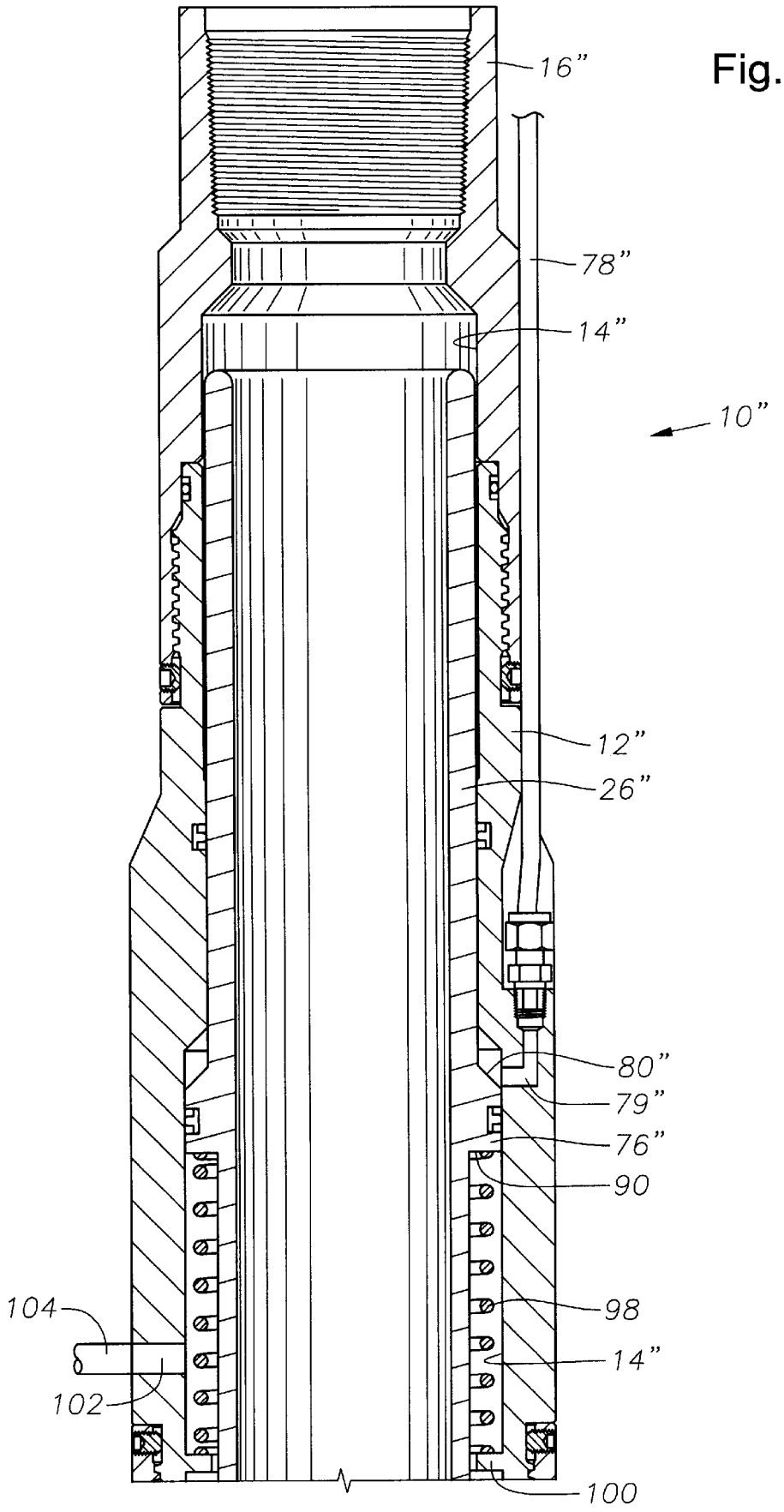
FIG. 9 is a longitudinal sectional view, similar to FIG. 8, showing an upper portion of another specific embodiment of the flow control device of the present invention.

Another biasing mechanism is shown in FIG. 9, which is a view similar to FIG. 8, and illustrates an upper portion of another specific embodiment of the present invention, which is referred to generally by the numeral 10". The lower portion of this embodiment is as shown in FIGS. 1C–1I. In this embodiment, a spring 98 is disposed within the first bore 14", about the first sleeve member 26", and between an annular shoulder 100 on the body member 12" and the second side 90" of the piston 76". As such, in this embodiment, force of the spring 98 is used instead of pressurized gas or hydraulic fluid to bias the first sleeve member 26" toward the first end 16" of the body member 12". Alternatively, as shown in FIG. 9, the device 10" may also include a port 102 in the body member 12" connected to a conduit 104 through which hydraulic fluid or pressurized gas may also be applied to the second side 90" of the piston 76" to assist the spring 98 in biasing the first sleeve member 26" toward the first end 16" of the body member 12". In this regard, if hydraulic fluid is desired, the conduit 104 may be a hydraulic conduit, such as the second hydraulic conduit 96 shown in FIG. 8. Alternatively, if pressurized gas is desired, the conduit 104 may be a gas conduit, such as the gas conduit 82 shown in FIGS. 1A–1B. In another specific embodiment, instead of using hydraulic fluid or pressurized gas, the port 102 may be in communication with annulus pressure, which may be used to bias the first sleeve member 26" toward the first end 16" of the body member 12", either by itself, or in combination with the spring 98.

Figure 6:
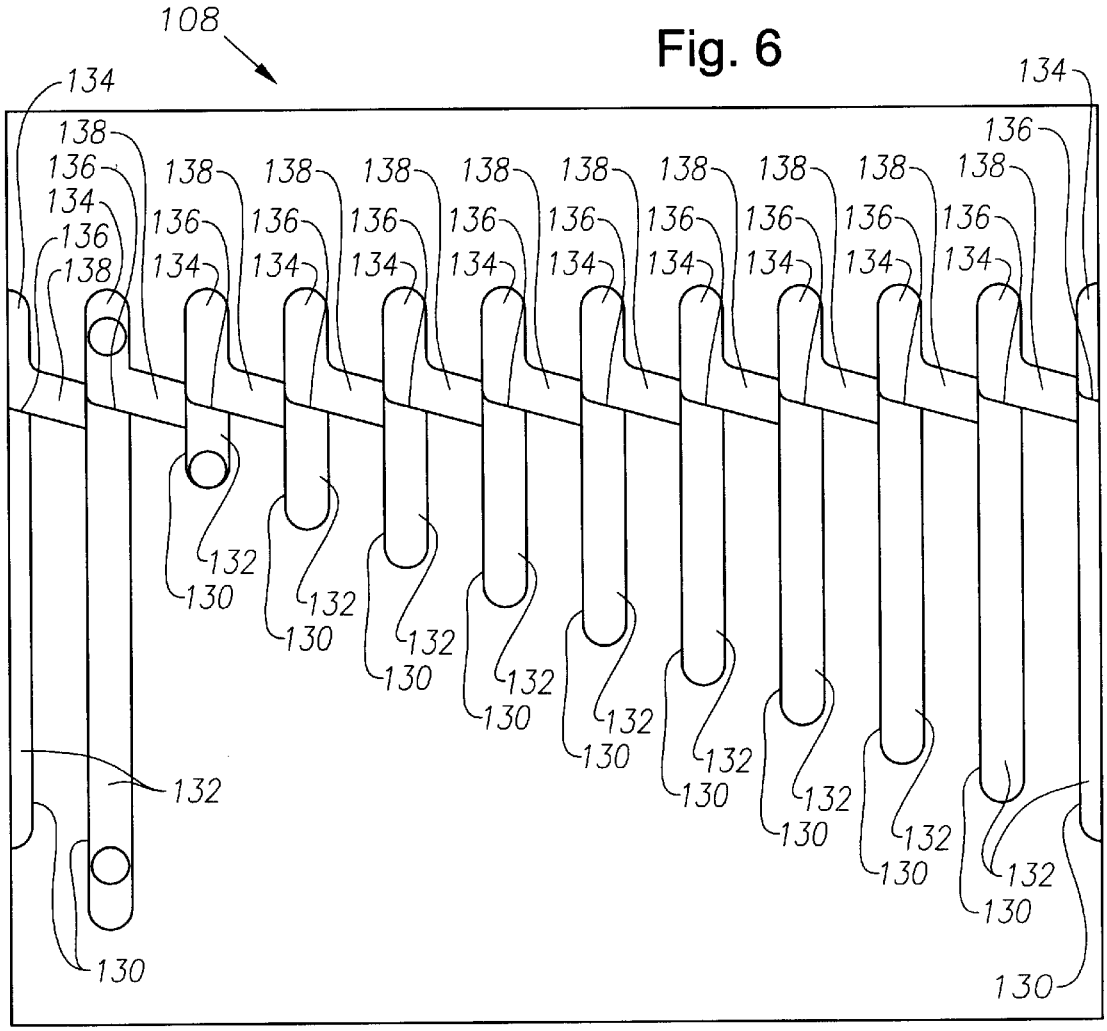
FIG. 6 illustrates a planar projection of an outer cylindrical surface of a position holder shown in FIGS. 1C and 1D.

Referring now to FIGS. 1C–1D and 6, the device 10 of the present invention may also include a position holder to enable an operator at the earth's surface (not shown) to remotely locate and maintain the first sleeve member 26 in a plurality of discrete positions, thereby providing the operator with the ability to remotely regulate fluid flow through the at least one flow port 24 in the extension member 17 (FIG. 1E), and/or through the at least one flow slot 30 in the first sleeve member 26 (FIG. 1E). The position holder may be provided in a variety of configurations. In a specific embodiment, as shown in FIGS. 1C–1D and 6, the position holder may include an indexing cylinder 106 having a recessed profile 108 (FIG. 6), and be adapted so that a retaining member 110 (FIG. 1D) may be biased into cooperable engagement with the recessed profile 108, as will be more fully explained below. In a specific embodiment, one of the position holder 106 and the retaining member 110 may be connected to the first sleeve member 26, and the other of the position holder 106 and the retaining member 110 may be connected to the body member 12. In a specific embodiment, the recessed profile 108 may be formed in the first sleeve member 26, or it may be formed in the indexing cylinder 106 disposed about the first sleeve member 26. In this embodiment, the indexing cylinder 106 and the first sleeve member 26 are fixed to each other so as to prevent longitudinal movement relative to each other. As to relative rotatable movement between the two, however, the indexing cylinder 106 and the first sleeve member 26 may be fixed so as to prevent relative rotatable movement between the two, or the indexing cylinder 106 may be slidably disposed about the first sleeve member 26 so as to permit relative rotatable movement. In the specific embodiment shown in FIGS. 1C–1D, in which the recessed profile 108 is formed in the indexing cylinder 106, the indexing cylinder 106 is disposed for rotatable movement relative to the first sleeve member 26, as per roller bearings 112 and 114, and ball bearings 116 and 118.

In a specific embodiment, with reference to FIGS. 1C–1D, the retaining member 110 may include an elongate body 120 having a cam finger 122 at a distal end thereof and a hinge bore 124 at a proximal end thereof. A hinge pin 126 is disposed within the hinge bore 124 and connected to the body member 12. In this manner, the retaining member 110 may be hingedly connected to the body member 12. A biasing member 128, such as a spring, may be provided to bias the retaining member 110 into engagement with the recessed profile 108. Other embodiments of the retaining member 110 are within the scope of the present invention. For example, the retaining member 110 may be a spring-loaded detent pin (not shown).

The recessed profile 108 will now be described with reference to FIG. 6, which illustrates a planar projection of the recessed profile 108 in the indexing cylinder 106. As shown in FIG. 6, the recessed profile 108 preferably includes a plurality of axial slots 130 of varying length disposed circumferentially around the indexing cylinder 106, in substantially parallel relationship, each of which are adapted to selectively receive the cam finger 122 on the retaining member 110. While the specific embodiment shown includes twelve axial slots 130, this number should not be taken as a limitation. Rather, it should be understood that the present invention encompasses a recessed profile 108 having any number of axial slots 130. Each axial slot 130 includes a lower portion 132 and an upper portion 134. The upper portion 134 is recessed, or deeper, relative to the lower portion 132, and an inclined shoulder 136 separates the lower and upper portions 132 and 134. An upwardly ramped slot 138 leads from the upper portion 134 of each axial slot 130 to the elevated lower portion 132 of an immediately neighboring axial slot 130, with the inclined shoulder 136 defining the lower wall of each upwardly ramped slot 138.

In operation, the first sleeve member 26 is normally biased upwardly, so that the cam finger 122 of the retaining member 110 is positioned against the bottom of the lower portion 132 of one of the axial slots 130. When it is desired to change the position of the first sleeve member 26, hydraulic pressure should be applied from the first hydraulic conduit 78 (FIG. 1B) to the first side 80 of the piston 76 for a period long enough to shift the cam finger 122 into engagement with the recessed upper portion 134 of the axial slot 130. Hydraulic pressure should then be removed so that the first sleeve member 26 is biased upwardly, thereby causing the cam finger 122 to engage the inclined shoulder 136 and move up the upwardly ramped slot 138 and into the lower portion 132 of the immediately neighboring axial slot 130 having a different length. It is noted that, in the specific embodiment shown, the indexing cylinder 106 will rotate relative to the retaining member 110, which is hingedly secured to the body member 12. By applying and removing pressurized fluid from the first side 80 of the piston 76, the cam finger 122 may be moved into the axial slot 130 having the desired length corresponding to the desired position of the first sleeve member 26. This enables an operator at the earth's surface to shift the first sleeve member 26 into a plurality of discrete positions and control the distance between the first and second valve seats 22 and 28 (FIG. 1E), and thereby regulate fluid flow through the at least one flow port 24 and/or the at least one flow slot 30.

Figure 10:
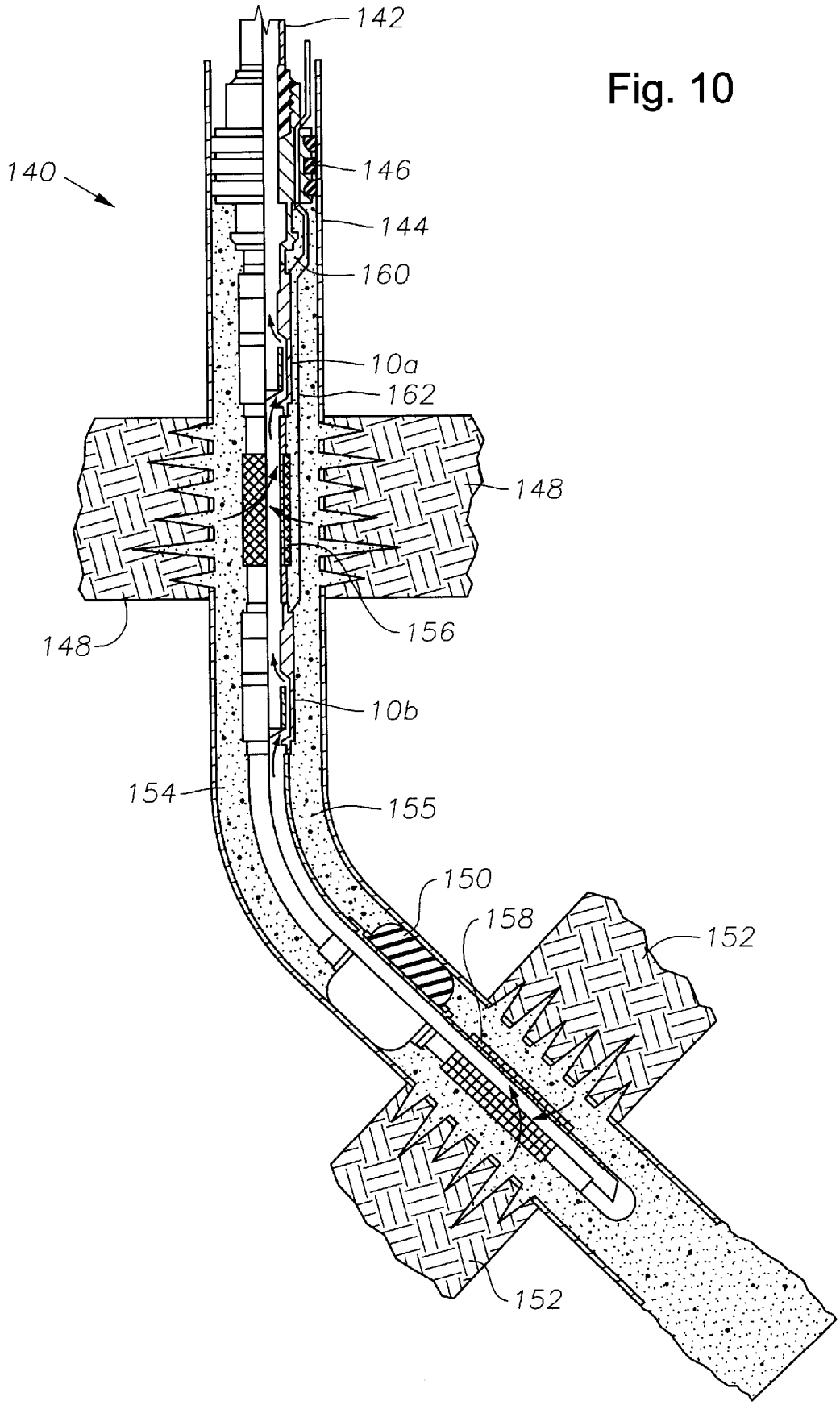
FIG. 10 is a schematic representation of a specific embodiment of a well completion in which the flow control device of the present invention may be used.

Methods of using the flow control device 10 of the present invention will be now be explained in connection with a specific embodiment of a well completion denoted generally by the numeral 140, as illustrated in FIG. 10. Referring now to FIG. 10, the well completion 140 may include a production tubing 142 extending from the earth's surface (not shown) and disposed within a well casing 144, with a first packer 146 connected to the tubing 142 and disposed above a first hydrocarbon formation 148, and a second packer 150 connected to the tubing 142 and disposed between the first hydrocarbon formation 148 and a second hydrocarbon formation 152. A well annulus 154 may be packed with gravel 155. A first sand screen 156 may be connected to the tubing 142 adjacent the first formation 148, and a second sand screen 158 may be connected to the tubing 142 adjacent the second formation 152. A first flow control device 10*a* of the present invention may be connected to the tubing 142 and disposed between the first packer 146 and the first formation 148, and a second flow control device 10*b* of the present invention may be connected to the tubing 142 and disposed between the first formation 148 and the second packer 150. A first hydraulic conduit 160 may be connected from a source of pressurized fluid (not shown), such as at the earth's surface (not shown), to the first flow control device 10*a*, and a second hydraulic conduit 162 may be connected from a source of pressurized fluid (not shown), such as at the earth's surface (not shown), to the second flow control device 10*b*.

In a specific embodiment, the pressure within the first formation 148 may be greater than the pressure within the second formation 152. In this case, it may be desirable to restrict fluid communication between the first and second formations 148 and 152, otherwise hydrocarbons from the first formation 148 would flow into the second formation 152 instead of to the earth's surface. To this end, the first sleeve member 26 (FIGS. 1A–1G) within the second flow control device 10*b* may be remotely shifted upwardly to bring the first and second valve seats 22 and 28 into sealing contact, thereby preventing fluid communication between the first and second formations 148 and 152. The first sleeve member 26 in the first flow control device 10*a* may be remotely shifted to regulate fluid flow from the first formation 148 to the earth's surface. The first and second flow control devices 10*a* and 10*b* may be remotely manipulated as required depending upon which formation is to be produced, and/or whether wireline intervention techniques are to be performed.

The flow control device 10 of the present invention may be used to produce hydrocarbons from a formation, such as formation 148 or 152, to the earth's surface, or to inject chemicals from the earth's surface (not shown) into the well annulus 154, and/or into a hydrocarbon formation, such as formation 148 or 152. If the device 10 is to be used for producing fluids, then the device 10 should be positioned with the first end 16 of the device 10 (FIG. 1A) above the second end 20 of the device 10 (FIG. 11). But if the device 10 is to be used to inject chemicals, then the device 10 should be positioned "upside down" so that the second end 20 is above the first end 16.

It is to be understood that the invention is not limited to the exact details of construction, operation, exact materials or embodiments shown and described, as obvious modifications and equivalents will be apparent to one skilled in the art. For example, while the device 10 has been described as being remotely controlled via at least one hydraulic conduit (e.g., conduit 78 in FIG. 1A), the device 10 could just as easily be remotely controlled via an electrical conductor and still be within the scope of the present invention. Additionally, while the device 10 of the present invention has been described for use in well completions which include gravel pack in the well annulus, the device 10 may also be used in well completions lacking gravel pack and still be within the scope of the present invention. Accordingly, the invention is therefore to be limited only by the scope of the appended claims.

What is claimed is:

1. A downhole flow control device comprising:

a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore;

a first sleeve member remotely shiftable within the first bore, and having a second valve seat adapted for cooperable sealing engagement with the first valve seat to regulate fluid flow through the at least one flow port;

a closure member disposed for movement between an open and a closed position to control fluid flow through the first bore; and a second sleeve member remotely shiftable within the first bore to move the closure member between its open and closed positions, wherein the second sleeve member includes an inner surface having a locking profile for mating with a shifting tool.

2. A downhole flow control device comprising:

a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore;

a first sleeve member remotely shiftable within the first bore, and having a second valve seat adapted for cooperable sealing engagement with the first valve seat to regulate fluid flow through the at least one flow port;

a closure member disposed for movement between an open and a closed position to control fluid flow through the first bore; and a second sleeve member remotely shiftable within the first bore to move the closure member between its open and closed positions, wherein the second sleeve member includes at least one rib releasably engageable with at least one annular recess within the first bore of the extension member.

3. A downhole flow control device comprising:

a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore;

a first sleeve member remotely shiftable within the first bore, and having a second valve seat adapted for cooperable sealing engagement with the first valve seat to regulate fluid flow through the at least one flow port;

a closure member disposed for movement between an open and a closed position to control fluid flow through the first bore; and a second sleeve member remotely shiftable within the first bore to move the closure member between its open and closed positions, wherein the second sleeve member includes a plurality of collet sections having a plurality of ribs disposed thereon for releasable engagement with at least one annular recess within the first bore of the extension member.

4. A downhole flow control device comprising:

a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore;

a first sleeve member remotely shiftable within the first bore, and having a second valve seat adapted for cooperable sealing engagement with the first valve seat to regulate fluid flow through the at least one flow port;

a closure member disposed for movement between an open and a closed position to control fluid flow through the first bore;

a second sleeve member remotely shiftable within the first bore to move the closure member between its open and closed positions, wherein the second sleeve member includes at least one first equalizing port for cooperating with at least one second equalizing port in the extension member to equalize pressure on opposed sides of the closure member prior to shifting the closure member to its open position; and seal means for preventing fluid communication between the at least one first and second equalizing ports when the second sleeve member is in a non-equalizing position.

5. A downhole flow control device comprising:

a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore;

a first sleeve member remotely shiftable within the first bore, and having a second valve seat adapted for cooperable sealing engagement with the first valve seat to regulate fluid flow through the at least one flow port;

a closure member disposed for movement between an open and a closed position to control fluid flow through the first bore;

a second sleeve member remotely shiftable within the first bore to move the closure member between its open and closed positions; and a cone member connected to a distal end of the extension member.

6. The downhole flow control device of claim 5, wherein the cone member includes a first halftone member and a second half-cone member, each being hingedly connected to the distal end of the extension member and biased towards each other in a normally-closed position.

7. The downhole flow control device of claim 6, wherein an angle formed between a first outer surface of the first half-cone member and a second outer surface of a second half-cone member is approximately forty-four degrees when the cone member is in its normally-closed position.

8. The downhole flow control device of claim 6, wherein the second sleeve member is remotely shiftable to a lower position in which the first and second half-cone members are shifted to open positions in which a first inner surface of the first half-cone member is disposed about the second sleeve member, and a second inner surface of the second half-cone member is disposed about the second sleeve member.

9. A downhole flow control device comprising:

a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore;

a first sleeve member remotely shiftable within the first bore, and having a second valve seat adapted for cooperable sealing engagement with the first valve seat to regulate fluid flow through the at least one flow port;

a closure member disposed for movement between an open and a closed position to control fluid flow through the first bore; and a second sleeve member remotely shiftable within the first bore to move the closure member between its open and closed positions;

a piston connected to the first sleeve member and movably disposed within the body member in response to applications of pressure;

a first hydraulic conduit connected between a source of pressurized fluid and the body member, and being in fluid communication with a first side of the piston; and a port in the body member establishing fluid communication between a well annulus and a second side of the piston.

10. A downhole flow control device comprising:

a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore;

a first sleeve member remotely shiftable within the first bore, and having a second valve seat adapted for cooperable sealing engagement with the first valve seat to regulate fluid flow through the at least one flow port;

a closure member disposed for movement between an open and a closed position to control fluid flow through the first bore;

a second sleeve member remotely shiftable within the first bore to move the closure member between its open and closed positions, wherein the second sleeve member includes at least one first equalizing port for cooperating with at least one second equalizing port in the extension member to equalize pressure on opposed sides of the closure member prior to shifting the closure member to its open position; and a position holder cooperably engageable with a retaining member, one of the position holder and the retaining member being connected to the first sleeve member, and the other of the position holder and the retaining member being connected to the body member.

11. The downhole flow control device of claim 10, wherein the position holder includes a recessed profile in which a portion of the retaining member is engaged and movably disposed to hold the sleeve member in a plurality of discrete positions.

12. The downhole flow control device of claim 11, wherein the recessed profile includes a plurality of axial slots of varying lengths disposed circumferentially about the position holder and in substantially parallel relationship, and corresponding to a plurality of discrete positions for the first sleeve member, each axial slot having a recessed portion and an elevated portion, and each axial slot being connected to its immediately neighboring axial slots by ramped slots leading between corresponding recessed and elevated portions of each neighboring axial slot.

13. The downhole flow control device of claim 11, wherein the recessed profile is disposed in an indexing cylinder rotatably disposed about the first sleeve member.

14. The downhole flow control device of claim 13, wherein the indexing cylinder and the sleeve member are adapted to restrict longitudinal movement therebetween.

15. The downhole flow control device of claim 10, wherein the retaining member includes an elongate body having a cam finger at a distal end thereof engaged with and movably disposed within a recessed profiled in the position holder, and a proximal end of the elongate body being hingedly attached to one of the sleeve member and body member.

16. The downhole flow control device of claim 10, further including means for biasing the retaining member into engagement with the position holder.

17. A downhole flow control device comprising:

a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore;

a first sleeve member remotely shiftable within the first bore, and having a second valve seat adapted for cooperable sealing engagement with the first valve seat to regulate fluid flow through the at least one flow port;

a closure member disposed for movement between an open and a closed position to control fluid flow through the first bore;

a second sleeve member remotely shiftable within the first bore to move the closure member between its open and closed positions; and a cone member connected to a distal end of the extension member.

18. The downhole flow control device of claim 17, wherein the cone member includes a first half-cone member and a second half-cone member, each being hingedly connected to the distal end of the extension member and biased towards each other in a normally-closed position.

19. The downhole flow control device of claim 18, wherein an angle formed between a first outer surface of the first half-cone member and a second outer surface of a second half-cone member is approximately forty-four degrees when the cone member is in its normally-closed position.

20. The downhole flow control device of claim 17, wherein the first sleeve member further includes at least one flow slot.

21. The downhole flow control device of claim 17, wherein the closure member is a flapper hingedly connected to the extension member.

22. The downhole flow control device of claim 17, further including a piston connected to the first sleeve member and movably disposed within the body member in response to application of pressure.

23. The downhole flow control device of claim 22, further including means for moving the piston.

24. The downhole flow control device of claim 17, further including means for holding the first sleeve member in a plurality of discrete positions.

25. A downhole flow control device comprising:

a body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore;

a first sleeve member remotely shiftable within the first bore, and having a second valve seat adapted for cooperable sealing engagement with the first valve seat; to regulate fluid flow through the at least one flow port;

a piston movably disposed within the body member;

a closure member disposed for movement between an open and a closed position to control fluid flow through the first bore;

a second sleeve member remotely shiftable within the first bore to move the closure member between its open and closed positions; and a cone member connected to a distal end of the extension member.

26. A well completion including:

a well casing in fluid communication with a first hydrocarbon formation;

a production tubing disposed within the well casing;

gravel packed in an annulus between the well casing and the production tubing; a first packer connected to the tubing and disposed above the first hydrocarbon formation;

a first sand screen adjacent the first hydrocarbon formation, connected to the tubing, and establishing fluid communication between the first hydrocarbon formation and the production tubing;

a first flow control device connected to the tubing and disposed between the first packer and the first hydrocarbon formation, the first flow control device having a body member and a first sleeve member, the body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore, and the first sleeve member being remotely shiftable within the first bore, and having a second valve seat adapted for cooperable sealing engagement with the first valve seat to regulate fluid flow through the at least one flow port.

27. The well completion of claim 26, wherein the first end of the body member is positioned above the second end of the body member.

28. The well completion of claim 26, wherein the second end of the body member is positioned above the first end of the body member.

29. The well completion of claim 26, further including a first hydraulic conduit connected between a source of pressurized fluid and the first flow control device.

30. The well completion of claim 29, further including:

a second packer connected to the tubing and disposed below the first hydrocarbon formation and above a second hydrocarbon formation;

a second sand screen adjacent the second hydrocarbon formation, connected to the tubing, and establishing fluid communication between the second hydrocarbon formation and the production tubing; and a second flow control device connected to the tubing and disposed between the second packer and the first hydrocarbon formation, the second flow control device having a body member and a first sleeve member, the body member having a first bore extending from a first end of the body member and through an extension member disposed within the body member, a second bore extending from a second end of the body member and into an annular space disposed about the extension member, a first valve seat disposed within the first bore, and at least one flow port in the extension member establishing fluid communication between the annular space and the first bore, and the first sleeve member being remotely shiftable within the first bore, and having a second valve seat adapted for cooperable sealing engagement with the first valve seat to regulate fluid flow through the at least one flow port.

31. The well completion of claim 30, further including a second hydraulic conduit connected between the source of pressurized fluid and the second flow control device.

* * * * *